US012130119B2

(12) United States Patent
Salinas

(10) Patent No.: US 12,130,119 B2
(45) Date of Patent: Oct. 29, 2024

(54) OPTIC GUARD FOR FIREARM

(71) Applicant: AXTS INC, Redmond, OR (US)

(72) Inventor: Anibal Salinas, Baytown, TX (US)

(73) Assignee: AXTS INC., Redmond, OR (US)

( * ) Notice: Subject to any disclaimer, the term of this patent is extended or adjusted under 35 U.S.C. 154(b) by 0 days.

(21) Appl. No.: 18/346,149

(22) Filed: Jun. 30, 2023

(65) Prior Publication Data

US 2023/0358510 A1 Nov. 9, 2023

Related U.S. Application Data

(63) Continuation of application No. 17/156,504, filed on Jan. 22, 2021.

(60) Provisional application No. 62/965,711, filed on Jan. 24, 2020, provisional application No. 63/111,025, filed on Nov. 7, 2020.

(51) Int. Cl.

| | |
|---|---|
| ***F41G 11/00*** | (2006.01) |
| ***F41A 21/30*** | (2006.01) |
| ***F41A 21/32*** | (2006.01) |
| ***F41A 21/36*** | (2006.01) |

(52) U.S. Cl.

CPC ..... *F41G 11/00* (2013.01); *F41A 21/30* (2013.01); *F41A 21/325* (2013.01); *F41A 21/36* (2013.01)

(58) Field of Classification Search

CPC ... F41G 1/04; F41G 1/065; F41G 1/30; F41G 1/383; F41G 1/387; F41G 11/00; F41G 11/002

USPC ..... 42/143

See application file for complete search history.

(56) References Cited

U.S. PATENT DOCUMENTS

| | | | | |
|---|---|---|---|---|
| 198,670 A | | 12/1877 | Nichols | |
| 534,691 A | | 2/1895 | Hepburn | |
| 3,777,381 A | * | 12/1973 | Moller | F41G 1/00 42/71.01 |
| 3,978,762 A | | 9/1976 | Khaidurov | |
| 4,562,767 A | | 1/1986 | Janssen | |

(Continued)

FOREIGN PATENT DOCUMENTS

| | | | | |
|---|---|---|---|---|
| DE | 202008003636 U1 | | 8/2008 | |
| DE | 202009010664 U1 | * | 12/2009 | F41G 11/005 |

OTHER PUBLICATIONS

USPTO; Non-Final Office Action; U.S. Appl. No. 17/156,503; Jul. 13. 2023, pp. 1-31.

(Continued)

*Primary Examiner* — Joshua E Freeman
*Assistant Examiner* — Benjamin S Gomberg
(74) *Attorney, Agent, or Firm* — Schwabe Williamson & Wyatt

(57) ABSTRACT

An optic guard for a firearm may include: a frame; and a bracket having a first side to attach to a firearm assembly, the bracket integrally formed with the frame or fixably attached to the frame at a second side of the bracket. The frame may be arranged to protect a top and sides of the optic when the first side of the bracket is attached to the firearm assembly. In some embodiments, the second side of the bracket defines an optic attachment, wherein the frame protects the top and sides of the optic when the optic is coupled to the bracket using the optic attachment. In some embodiments, the first side of the bracket may define a protrusion or opening to mate with an opening or protrusion in front of an optic mounting platform.

36 Claims, 32 Drawing Sheets

(56) References Cited

U.S. PATENT DOCUMENTS

| | | | | |
|---|---|---|---|---|
| 4,570,529 | A | 2/1986 | A'Costa | |
| 4,691,614 | A | 9/1987 | Leffel | |
| 4,827,652 | A | 5/1989 | Martin | |
| 4,893,426 | A | 1/1990 | Bixler | |
| 4,930,397 | A | 6/1990 | Seidler | |
| 5,076,137 | A | 12/1991 | Paredes | |
| 5,549,030 | A | 8/1996 | Lespron | |
| 5,815,936 | A * | 10/1998 | Sieczka | G03H 1/0005 42/114 |
| 6,327,806 | B1 * | 12/2001 | Paige | F41G 1/30 42/130 |
| 6,516,551 | B2 * | 2/2003 | Gaber | F41G 1/30 356/256 |
| 7,647,721 | B1 | 1/2010 | Gaber | |
| 8,024,885 | B1 * | 9/2011 | Newhall | F41G 1/04 42/129 |
| 8,082,688 | B2 * | 12/2011 | Elpedes | F41G 1/30 42/131 |
| 8,186,093 | B1 * | 5/2012 | Chung | F41G 1/35 42/119 |
| 8,468,734 | B2 | 6/2013 | Meller | |
| 9,372,049 | B2 * | 6/2016 | Cheng | F41G 1/30 |
| 9,423,212 | B2 | 8/2016 | Campean | |
| 9,574,853 | B2 | 2/2017 | Crispin | |
| 9,696,114 | B1 * | 7/2017 | Cabrera | F41G 1/10 |
| 9,995,550 | B2 | 6/2018 | Shelton | |
| 10,139,197 | B1 * | 11/2018 | Horton | F41G 1/383 |
| 10,247,515 | B2 * | 4/2019 | Collin | F41G 1/30 |
| 11,002,517 | B1 * | 5/2021 | Holly | F41G 1/30 |
| 11,150,051 | B2 * | 10/2021 | Connolly | F41G 1/387 |
| 11,300,382 | B2 * | 4/2022 | Holly | F41G 1/46 |
| 11,692,793 | B2 | 7/2023 | Nackel | |
| 11,788,818 | B2 | 10/2023 | Roth | |
| 11,841,210 | B2 | 12/2023 | Sun | |
| 11,852,427 | B2 | 12/2023 | Bachstein | |
| 2008/0134561 | A1 * | 6/2008 | Clouser | F41G 1/42 42/127 |
| 2013/0263491 | A1 * | 10/2013 | Jung | F41G 1/30 42/113 |
| 2013/0283660 | A1 | 10/2013 | Matthews et al. | |
| 2014/0230305 | A1 * | 8/2014 | Zimmer | F41C 3/00 42/111 |
| 2014/0305022 | A1 * | 10/2014 | Chung | F41G 1/387 42/113 |
| 2016/0209154 | A1 | 7/2016 | Wilson | |
| 2017/0023326 | A1 | 1/2017 | Wilson | |
| 2017/0030679 | A1 | 2/2017 | Campbell | |
| 2018/0017356 | A1 | 1/2018 | Cabrera | |
| 2018/0195835 | A1 | 7/2018 | Crispin | |
| 2019/0257620 | A1 * | 8/2019 | Zimmer | F41C 3/00 |
| 2019/0277600 | A1 * | 9/2019 | Larsson | F41G 1/345 |
| 2019/0331461 | A1 * | 10/2019 | Zimmer | F41G 1/17 |
| 2020/0025520 | A1 * | 1/2020 | Niswander | F41G 11/003 |
| 2020/0232759 | A1 | 7/2020 | York | |
| 2020/0292269 | A1 | 9/2020 | Guillen | |
| 2021/0025673 | A1 * | 1/2021 | Niswander | F41G 1/30 |
| 2021/0088301 | A1 | 3/2021 | Warburton | |
| 2021/0156646 | A1 * | 5/2021 | Schulte | F41G 1/16 |
| 2021/0222970 | A1 | 7/2021 | Ribic | |
| 2021/0231399 | A1 | 7/2021 | Salinas et al. | |
| 2021/0231400 | A1 | 7/2021 | Salinas et al. | |
| 2021/0231407 | A1 | 7/2021 | Salinas | |
| 2022/0244020 | A1 | 8/2022 | Morell | |
| 2023/0033894 | A1 | 2/2023 | Salinas et al. | |
| 2023/0090595 | A1 | 3/2023 | Underwood | |

OTHER PUBLICATIONS

JP Enterprises, "JPA-TANSN—Joint mount with integral guard wings, for Trijicon TA01-NSN ACOG scope", Jan. 12, 2018 web archive of https://jprifles.com/buy.php?item=JPA-TANSN, 1 page.
Redwolf Airsoft, "G&P OP Type Red Dot w/ Adjustable Guard Mount", Accessed Jan. 24, 2020 from http://www.redwolfairsoft.com/redwolf/airsoft/Accessories_Scopes_and_Sights_AEG_G_P_OP_Type_Red_Dot_w_Adjustable_Guard_Mount_Sand.htm, 3 pages.
Reptilia, "RMR Backup Mounting Options for 30MM Optics", Posted Jul. 17, 2019 on The Firearm Blog at https://www.thefirearmblog.com/blog/2019/07/17/reptilia-rmr/, 23 pages.
Sig Sauer, Romeo1 Shroud Kit Fits Romeo1 Only, Oct. 15, 2018, retrieved from URL: https://www.opticsplanet.com/sig-sauer-romeo1-shroud-kit-fits romeo1-only.html, 3 pages.
DCPrecisionllc; Dc Port Tracker; Instagram; Mar. 2, 2021; 5 pages; https://www.instagram.com/p/CL7n-agreW6/?utm_source=ig_web_button_share_sheet.
JP Enterprises, JPOINT4-WPG-ROS, May 20, 2018 web archive, URL: https://web.archive.org/web/20180520062944/https://www.jprifles.com/buy.;hp?item=JPINT4-WPG-ROS.
Imminent Threat Solutions, "DIY AR-15 Build: Front Sight Base Installation", https://www.itstactical.com/warcom/firearms/diy-ar-15-build-front-sight-base-installation/ At least prior to Jan. 24, 2020, pp. 1-17.
Weapons Armament Research; "Now Accepting Orders for the Afterburner. Please Visit our Website", Instagram, Jun. 7, 2017.
Weapons Armament Research; "Afterburner", Instagram, May 26, 2017.
Weapons Armament Research; "Afterburner", Instagram, May 28, 2017.
Weapons Armament Research; "Afterburner", Instagram, Jun. 2, 2017.
Weapons Armament Research; "Afterburner", Instagram, Jun. 7, 2017.
Thefirearmsblog.com, "*Mayhem Syndicate CALI Compensator System*", On-line Blog, May 23, 2018, pp. 1-18, https://www.thefirearmblog.com/blog/2018/05/23/mayhem-syndicate-cali-compensator-system/.
Salinas, Anibal, unpublished M&P Slice cut diagrams that describe features present within an end product of an M&P 2.0 slide porting service offered for sale at least as early as Jun. 7, 2017.
Salinas, Anibal, Web page, Weapons Armament Research, at least as early as Dec. 10, 2016; https://www.instagram.com/p/BN3Fw4PgQLL/?utm source=ig web copy link&igsh=Mz RlODBiNWFIZA ==.
Tactical Toolbox, Video "If You Own a Glock . . . You Need to See This Mayhem Syndicate Glock Comp", YouTube video, See: 5:40-5:45; https://www.youtube.com/watch?v=kaXV6sfmMNk&ab channel=TacticalToolbox; Jun. 28, 2017.
Weapons Armament Research; "Compensator", Web page, Date: Oct. 29, 2018. https://www.instagram.com/reel/Bph-15zBh69/.
Mac Defense Industries, "Quick Rundown of the Install and Removal of the Stubby and Half-Chub Comp." Facebook Video. Nov. 6, 2020. https://www.facebook.com/macdefense/videos/quick-rundown-of-the-install-and-removal-of-the-stubby-and-half-chub-comp/1642922935887934/.
AR15.COM; "Buyer Beware: TROS Three Lug", Forum Thread, Nov. 12, 2019. https://www.ar15.com/forums/Armory/Buyer-Beware-TROS-three-lug/20-504765/.
HB Industries, "CZ Scorpion 5.3" Micro K. Barrel", At least prior to Jan. 24, 2020. Web page https://hbindustries.net/store/shop/cz-scorpion-micro-k-barrel/#reviews.
Griffin Armament; Instagram Video, Aug. 2, 2020. https://www.instagram.com/p/CDalOnjh41g/?utm source=ig web copy link&igsh=MzRlODBINWFlZA%3D%3D.
Floyds Custom Shop; Instagram Video, "New Porting Option", Jun. 5, 2018. https://www.instagram.com/p/BigeP-8nSVd/?utm source=ig web copy link&igsh=MzRlODBINWFlZA%3D%3D.
Monsoon Tactical; Instagram, "Dopest C2 on the Gram", Oct. 6, 2020. https://www.instagram.com/p/CGBNx6spcED/?utm source=ig web copy link&igsh=MzRlODBINWFlZA%3D%3D.
Glock19C, Photograph, At least prior to Jan. 24, 2020.
Weapons Armament Research; "Afterburner", Instagram, Website, Nov. 11, 2018. https://www.instagram.com/p/BqDiWQBARHN/.
Tyrant CNC; "Glock Compatible T-Comp", Website, Feb. 14, 2019; https://www.tyrantcnc.com/glock-compensator.html.
Wing Tactical; "Clock Compensators—What to Know", Website, Nov. 17, 2020; https://www.wingtactical.com/blog/glock-compensators-what-to-know/.

(56) References Cited

OTHER PUBLICATIONS

FN Firearms, "The Edge of Performance is Here—Introducing the FN 509 LS Edge"; Website, Jan. 11, 2021, Press Release; https://fnamerica.com/press-releases/the-edge-of-performance-is-here-introducing-the-fn-509-Is-edge/.
Google Search, "Hellcat RDS Release Date", Website, Feb. 23, 2021; https://www.google.com/search?q=hellcat+rdp+release+date&rlz=1C1GCEA enUS1052US1052&oq=hellcat+rdp+release+date&gs Icrp=EgZjaHJvbWUyBggAEEUYOdIBCTU2MiVqMWoxNagCCLACAQ&sourceid=chrome&ie=UTF-8.
On Target Magazine; "Springfield Armory Hellcat RDP", Website, May 2021; https://www.ontargetmagazine.com/2021/05/springfield-armory-hellcat-rdp/.
Guns & Ammo; "Springfield Armory Hellcat RDP & Hellcat Pro 9 mm Pistols: Full Review", Website, Jan. 4, 2023; https://www.gunsandammo.com/editorial/springfield-armory-hellcat-rdp-hellcat-pro-9mm-pistols-full-review/467714.
Firearms News; "FN 509 CC Edge 9mm Compact Compensated Pistol First Look"; Website, Sep. 9, 2022; https://www.firearmsnews.com/editorial/fn-509-cc-edge-compact-compensated-pistol/464534.

* cited by examiner (Background)

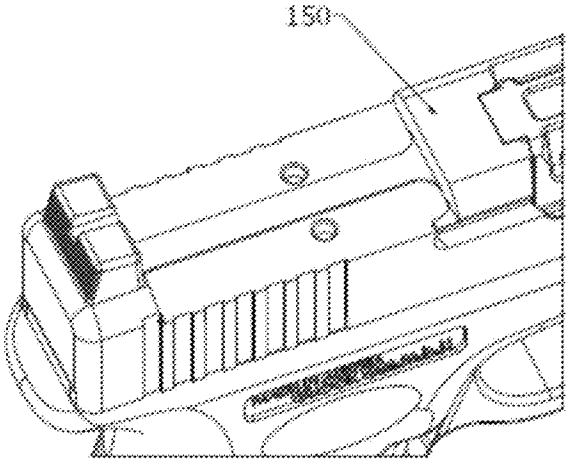
FIG. 1B (Background)
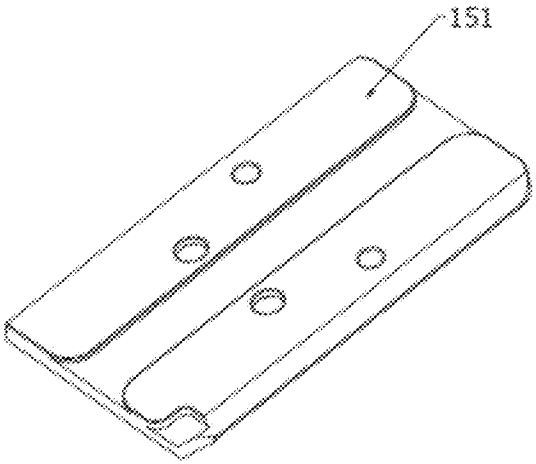
FIG. 1C (Background)
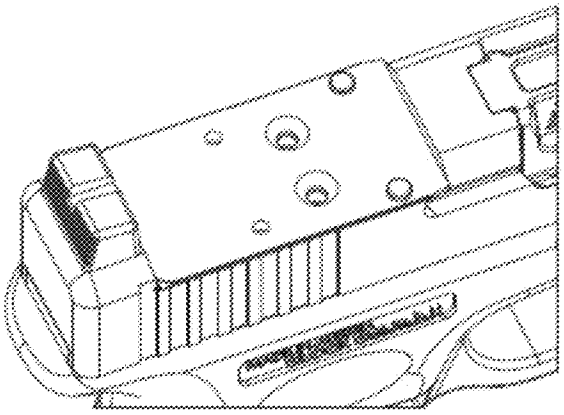
FIG. 1D (Background)
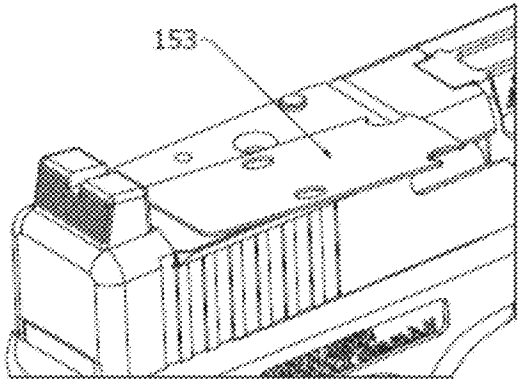
FIG. 1E (Background)
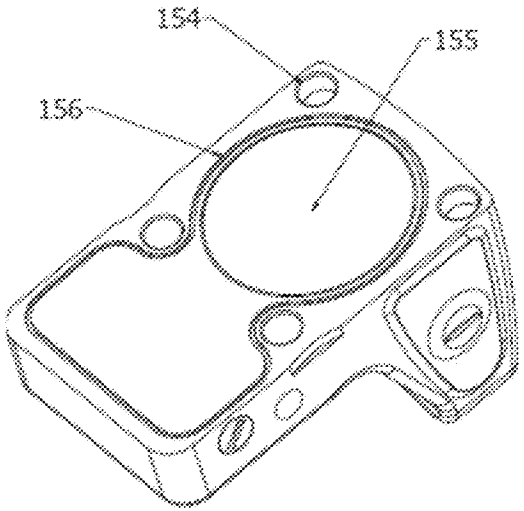
FIG. 1F (Background)
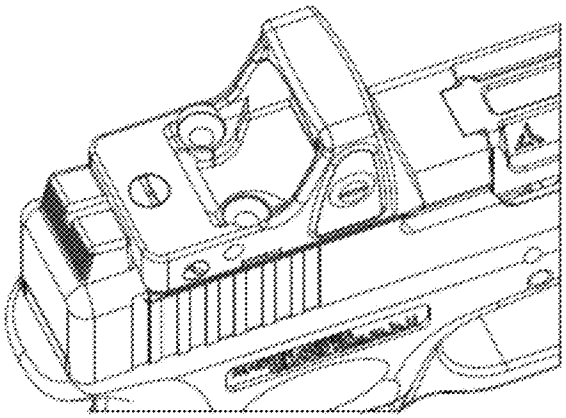
FIG. 1G (Background)

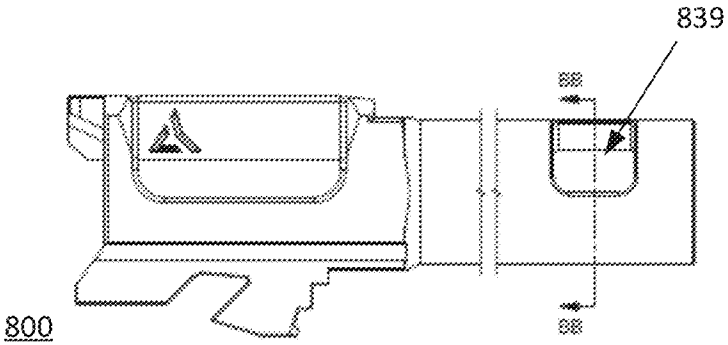
FIG. 8A
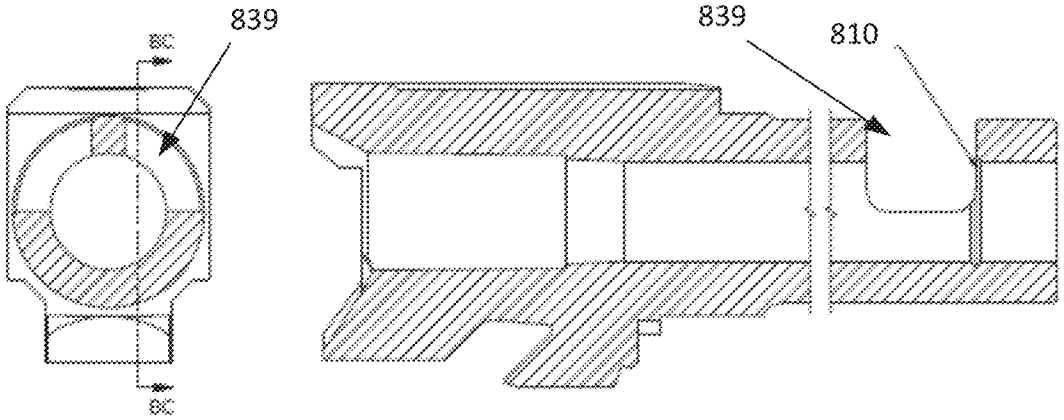
FIG. 8C
FIG. 8B

DETAIL K
ROUND TAPER PROFILE

OPTIC GUARD FOR FIREARM

PRIORITY

This application is a continuation application of U.S. patent application Ser. No. 17/156,504, filed Jan. 22, 2021 which claims priority to U.S. Provisional Application No. 62/965,711 filed on Jan. 24, 2020, and U.S. Provisional Application No. 63/111,025 filed on Nov. 7, 2020, each of which is incorporated by reference herein in their entirety.

BACKGROUND

Typical firearms propel a bullet or other type of projectile through the expansion of gas within a firearm barrel. The majority of the gas may be expelled out of the front of the firearm barrel together with the bullet. However, some firearms may exploit a portion of the gas to reduce recoil.

An accessory called a compensator can be used to retrofit a firearm with recoil reduction. These accessories are attached to the muzzle end of the barrel. However, this increases the total length of the firearm.

BRIEF DESCRIPTION OF THE DRAWINGS

FIG. 1B illustrates a partial top view of a slide with an MOS (modular optic system) cover plate removed.

FIG. 1C illustrates a bottom view of an MOS adapter plate.

FIG. 1D illustrates a slide assembly in which the MOS adapter plate of FIG. 1C is installed on the slide of FIG. 1B.

FIG. 1E illustrates installation of a sealing plate on the slide assembly of FIG. 1D.

FIG. 1F illustrates a bottom view of an RMR (rugged miniature reflex) optic.

FIG. 1G illustrates the RMR optic of FIG. 1F and the sealing plate of FIG. 1E installed on the slide assembly of FIG. 1D.

FIG. 8A illustrates a side view of another barrel in which rifling may be preserved between the muzzle end of the barrel and a location coinciding with a front-most edge of the egress.

FIG. 8B illustrates a cross-sectional view taken across a width of the barrel of FIG. 8A.

FIG. 8C illustrates a cross-sectional view taken along line BC of FIG. 8B.

DETAILED DESCRIPTION

Slide Assembly to Provide Gas Compensation to Reduce Recoil

Services have been offered to bore openings in a slide assembly to guide gas propelled from a chamber of a firearm in a direction to provide recoil reduction. The service provider obtains a slide assembly from the customer, removes material from various components of the slide assembly, and then returns the slide assembly to the customer.

In some services, the service provider removes material from a top half of the barrel to form a gas port. The service provider may also remove material from the top and/or sides of the slide around the gas port in the barrel in an attempt to vent some of the gas exiting the gas port out top and/or sides the slide. However, if these slide vents are not effective at venting the gas exiting the gas port, then the unvented gas may distribute carbon particles throughout the firearm, which may eventually degrade operation of the firearm.

Also, removing the material from the gas port in the barrel may leave burs that may contact a bullet passing by the gas port (on its way to the muzzle)—changing its trajectory. These burs may also strip material from the passing bullet. This stripped material, like the carbon particles, may be distributed through the firearm, which may eventually degrade operation of the firearm (also the stripped material is a safety concern for the shooter and/or bystanders).

Figure 1A:
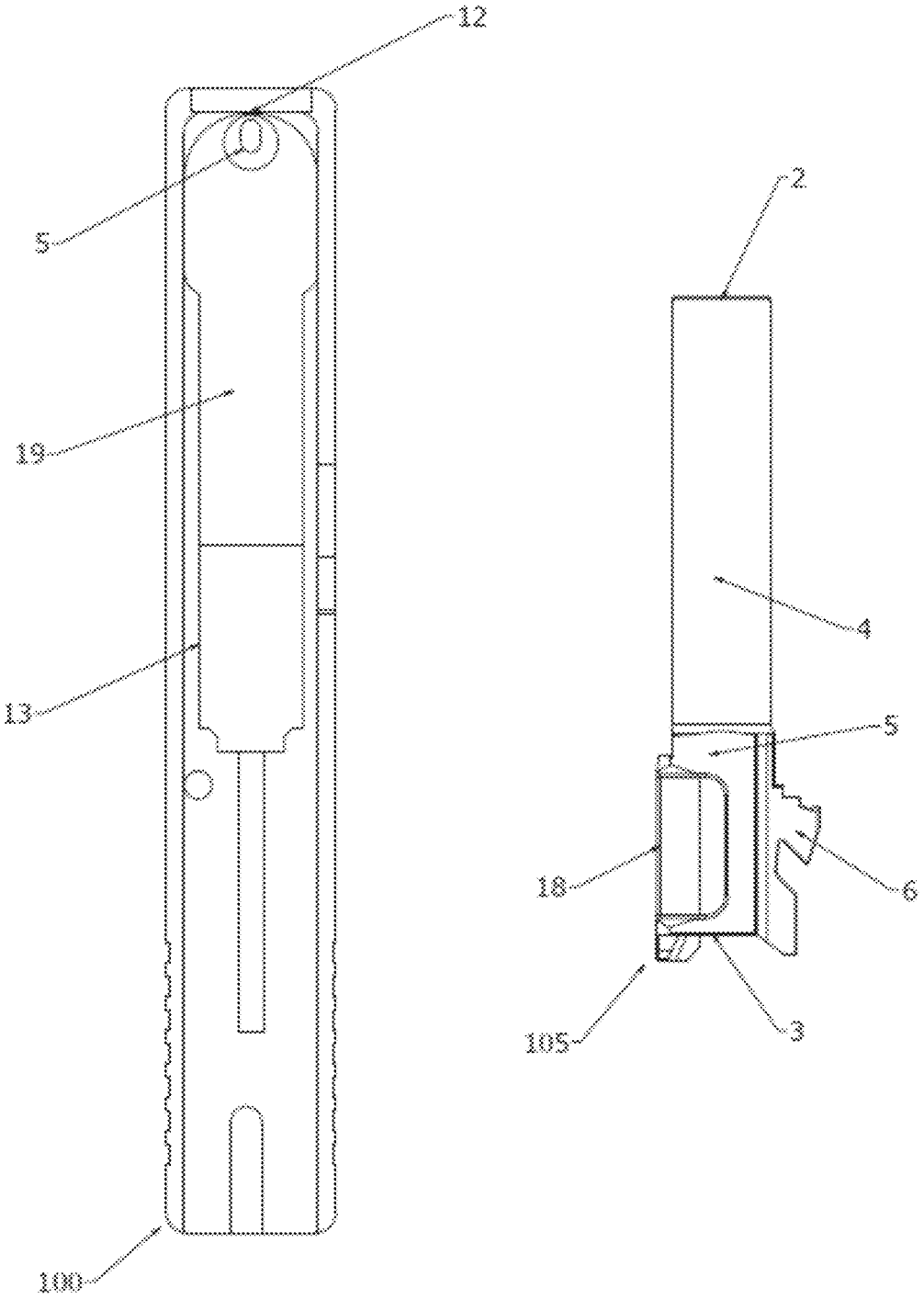
FIG. 1A illustrates a slide assembly including a bottom view of a slide and a side view of a barrel.

FIG. 1A illustrates a slide assembly including a bottom view of a slide 100 and a side view of a barrel 105. In this example, the slide 100 and barrel 105 are Glock-compatible. A Glock-compatible firearm component is compatible with the Glock design (but may be produced by a third party).

The barrel 105 includes a breech 3, a muzzle 2, and a length including a cylindrical bore length segment 4 (which includes the bore of the barrel 105) and a non-cylindrical barrel hood segment 5 (which includes the chamber of the barrel 105).

When the barrel 105 is locked into the slide 100, a tip of the muzzle end of the barrel 105 protrudes from the front of the slide 100. There are gaps between the rest of the bore length segment and the interior of the top and the sides of the slide 100. In particular, the width (w1) of the interior of the slide 100 corresponds to the width of the barrel hood, which accommodates rearward movement of the slide 100 relative to the barrel 105 following firing of the firearm. A wear marking 19 can be seen on the underside of the top of the slide 100 where the top of the barrel hood 18 (e.g., the side opposite the lugs 6) slides against the underside of the top of the slide 100 during this movement (the length of this wear marking 19 corresponds to the length of stroke of the firearm). In this slide assembly, these gaps are continuous from the opening 13 (which receives the top 18 of the barrel hood) past the sight mount 5 to the front interior wall 12 of the slide.

Figure 2A:
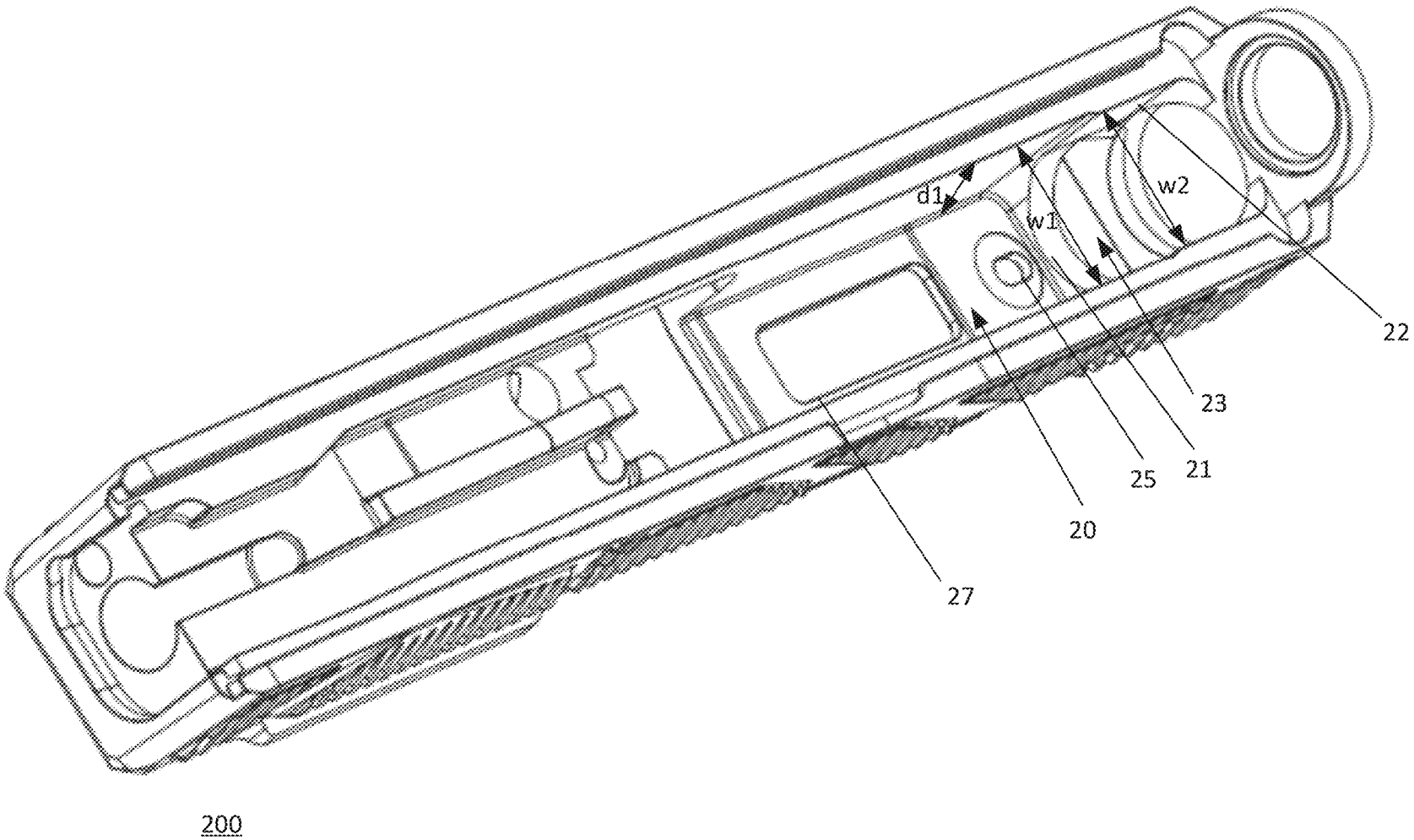
FIG. 2A illustrates a bottom view of a slide for a slide assembly to provide a firearm with gas compensation to reduce recoil.
Figure 2B:
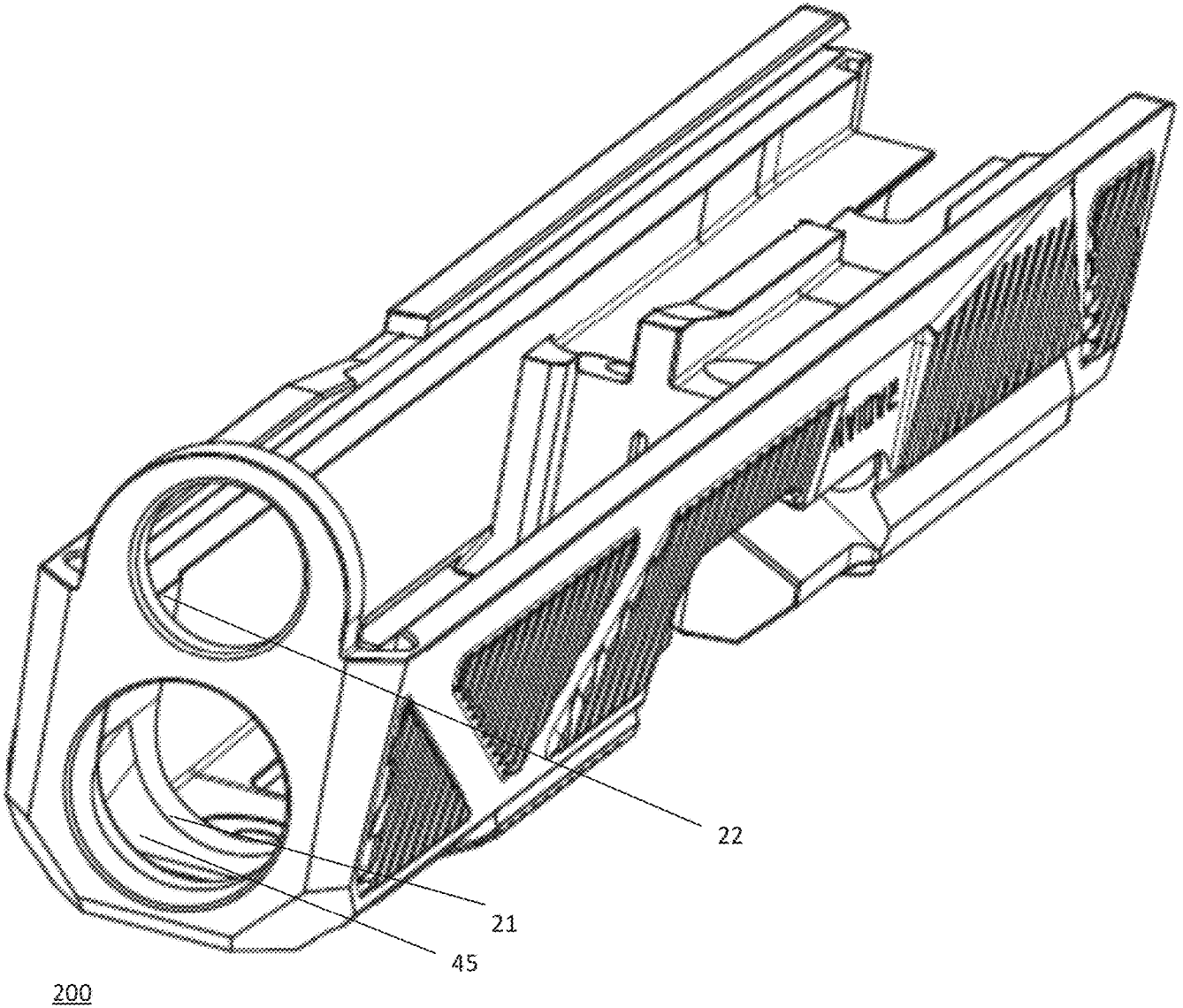
FIG. 2B illustrates a front view of the slide of FIG. 2A.

FIG. 2A illustrates a bottom view of a slide 200 for a slide assembly to provide a firearm with gas compensation to reduce recoil. FIG. 2B illustrates a front view of the slide 200.

The slide 200 may have the same compatibility as the slide 100 of FIG. 1. For instance, the slide 200 may be a retrofit for a firearm manufactured with the slide 100 of FIG. 1, in some examples (the slide 200 of course may also be an original part of a firearm, in other examples).

The interior of the top and sides of the slide 200 define an arch 21. A width (w2) of an interior of the arch 21 may be less than the width (w1). The same reference number w1 is used to indicate that the width behind the arch 21 may be the same as the width between the interior sides of the slide 100 of FIG. 1A. The width (w2) may correspond to a width of the bore length segment 4 (FIG. 1A).

Behind the arch 21 is a barrel hood channel 20 with the width (w1) and a depth (d1) corresponding to a height of the barrel hood 5 (FIG. 1A). The barrel hood channel 20 may receive the barrel hood through a range of motion of the slide 200 relative to the barrel responsive to a firing of the firearm. When the barrel is locked into the slide 200, a gap between the bore length segment of the barrel and the interior top and sides of the slide 200 in the barrel hood channel 20 may be the same as the gap with the bore length segment 4 and interior of the sides of the slide 100 (FIG. 1). In contrast, in a slide assembly using the slide 200, the gap between the bore length segment and the protrusions that define the interior sides and underside of the arch 21 may be less. In some embodiments, an underside of the arch 21 may be arranged to slidingly engage the upper region of the bore length segment in part of the range of motion (although this is not required). In some embodiments, the width (w2) may be at least the width of the bore length segment.

Figure 3:
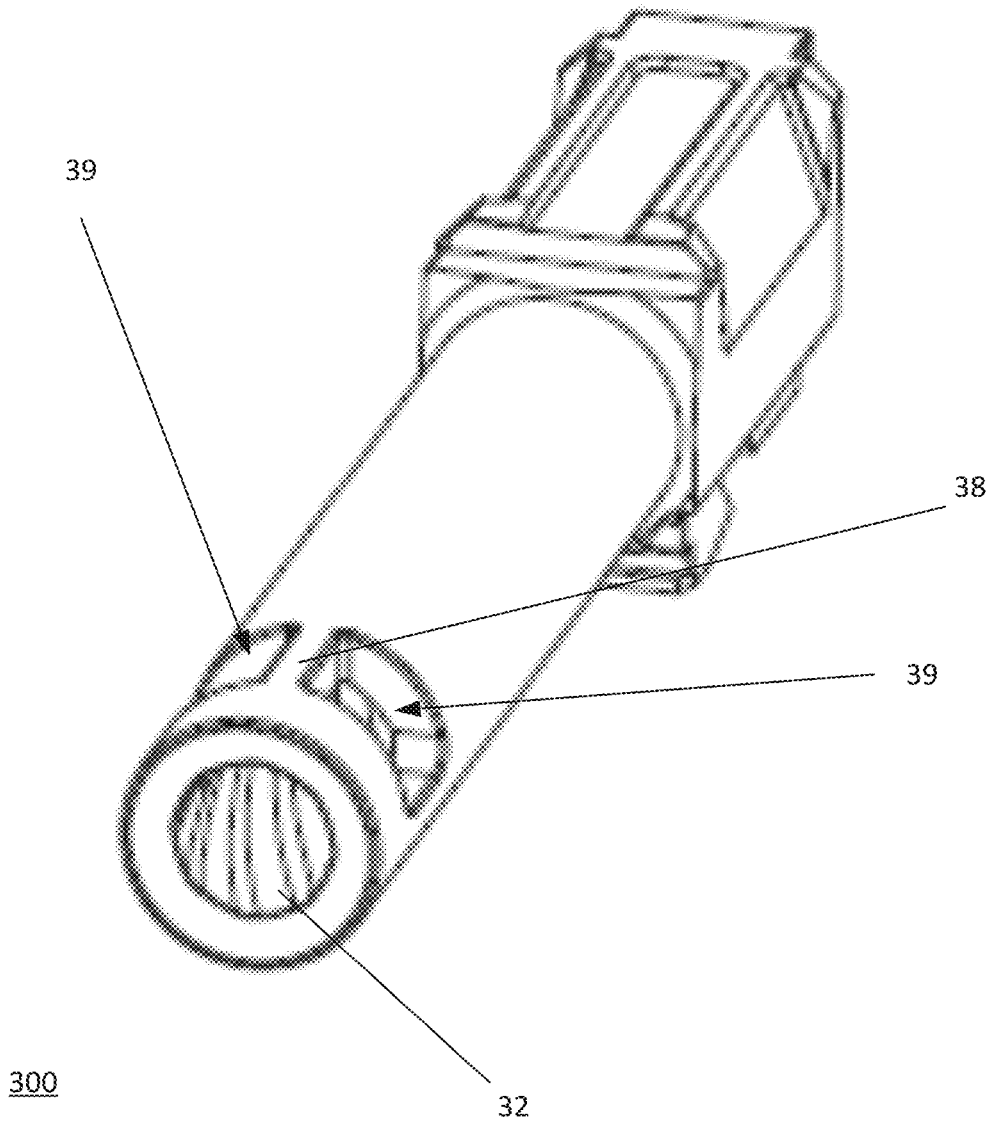
FIG. 3 illustrates a front view of a barrel operable with the slide of FIGS. 2A-B.

FIG. 3 illustrates a front view of a barrel 300 operable with the slide 200 of FIGS. 2A-B. An upper section of the barrel 300 (proximate to the muzzle 32) defines an egress 39 for gas propelled from the chamber of the firearm. In this example, a rib 38 is located between the openings. The egress 39 may be formed by removing material from a barrel similar to the barrel 105 (FIG. 1A).

Referring again to FIGS. 2A-B, the slide 200 may define an opening 23 in front of the arch 21 to expose the egress 39 (FIG. 3). In this embodiment, the opening 23 is a single contiguous opening; however, this is not required. Also, in this embodiment, the opening 23 is defined by protrusions on both the top and sides of the slide 200; however, this is not required. In other embodiments, the opening 23 may be defined by protrusions on the top and/or sides of the slide 200.

In this embodiment, protrusions 22 defined by the interior of the sides of the slide 200 may be located in front of the arch 21. The distance between surfaces of the protrusions 22 may be the same as the distance w2.

The slide 200 may include a sight mount opening 25 behind the arch 21. In this embodiment, the slide 200 also includes a window 27 located behind the arch 21 (the window 27 may facilitate cooling of the barrel 300; however, other embodiments may omit the window 27).

Referring again to FIG. 3, removing material from the egress 39 may be selective to form a rib 38 between separate bore openings of the egress 39. The exterior of the rib 38 is arranged to engage the underside of the arch 21 (FIG. 2A) following firing. This engagement prevents the underside of the arch 21 from catching on the egress 39. By selectively removing material from the egress 39 to leave the rib 38, the size of the egress 39 may be optimized to extend across substantially all of an upper half of a front section of the bore length segment of the barrel 300.

Figure 4A:
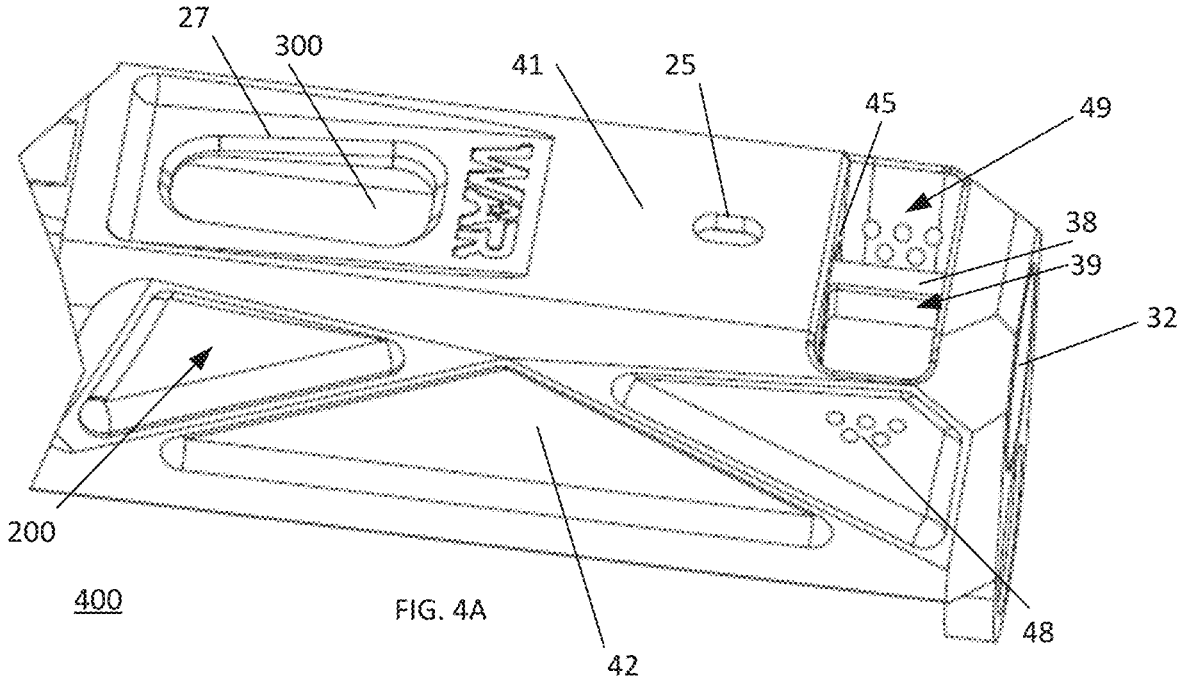
FIG. 4A illustrates a partial side view of firearm having slide assembly including the slide illustrated in FIGS. 2A-B and the barrel illustrated in FIG. 3.
Figure 4B:
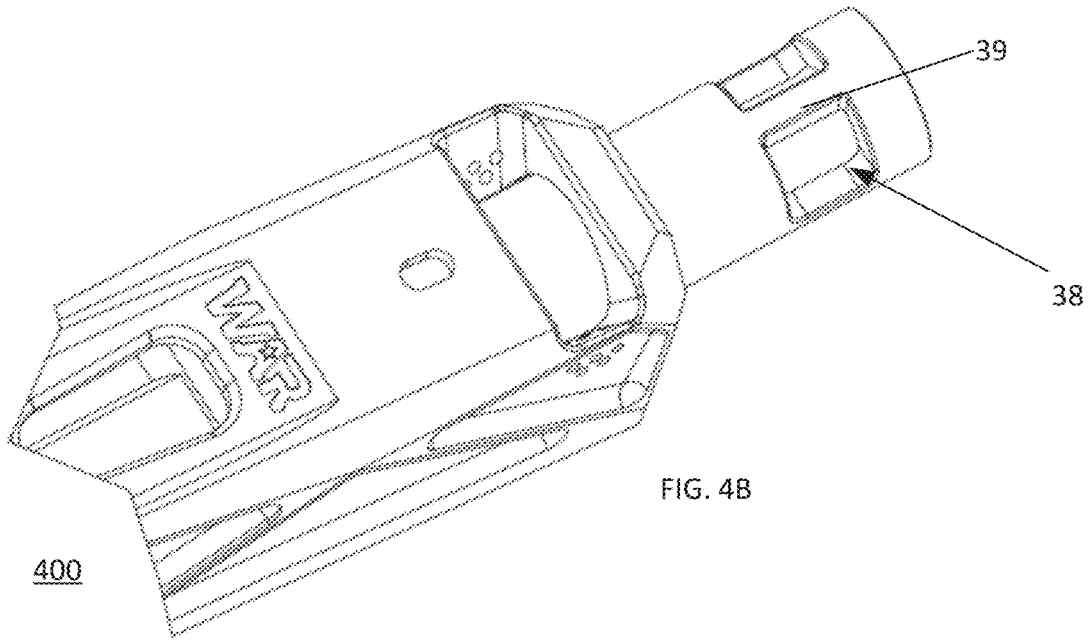
FIG. 4B illustrates a partial side view of firearm of FIG. 4A in which the slide is retracted.

FIG. 4A illustrates a partial side view of firearm having slide assembly 400 including the slide 200 illustrated in FIGS. 2A-B and the barrel 300 illustrated in FIG. 3. FIG. 4B illustrates a partial side view of firearm of FIG. 4A in which the slide 200 is retracted.

This embodiment includes a gas port 49 formed by the egress 39 of the barrel 300, a front surface 45 of the arch 21 (FIGS. 2A-B), the protrusions 22 (FIGS. 2A-B), an interior of a front of the slide 200, and the opening 23 (FIGS. 2A-B). In particular, sidewalls of the gas port 49 may include a surface of sidewalls of the egress 39, the front surface 45 of the arch 21, a surface of the protrusions 22, a surface of the interior of the front of the slide 200, and a surface of sidewalls of the opening 23. In other embodiments, a barrel gas port may be located a distance from one or more of the front surface 45 (the arch 21 may be located a distance behind the barrel gas port), a distance from surfaces of the interior of the sides of the slide (these surfaces may or may not include the protrusion 22), a distance from a surface of the interior of the front of the slide, and/or a distance from a surface of sidewalls of opening(s) in the slide.

In this embodiment, a group 48 of holes is located on the sides 42 of the slide (only one of the sides 42 is shown in this view). Each hole may include a first end on the exterior surface of the sides 42 and a second end on a sidewall of the gas port 49. The group 48 of holes may be omitted in other embodiments.

A transition edge between the top 41 and sides 42 of the slide 200 may be sloped (e.g., a beveled edge). A portion of a perimeter of the opening 23 (FIGS. 2A-B) in the slide 200 may be located on this sloped edge, as in the illustrated embodiment; however, this is not required.

Figure 5A:
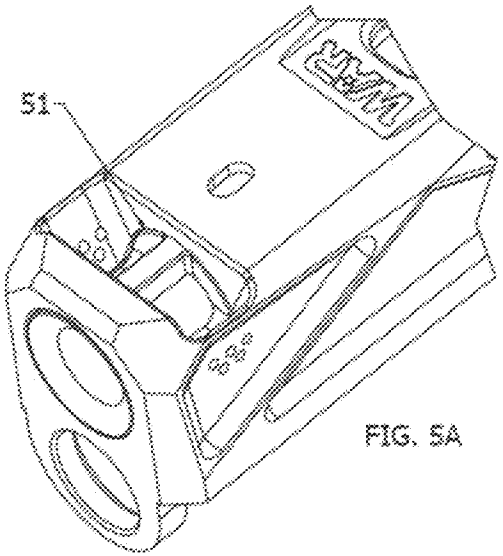
FIG. 5A illustrates a perspective view of a muzzle end of a slide assembly having a gas port formed from an egress in a barrel, a front surface of an arch on the underside of the slide, an opening in the slide, and an interior of a front end of the slide.

FIG. 5A illustrates a perspective view of a muzzle end of a slide assembly having a gas port formed from an egress in a barrel, a front surface of an arch on the interior of the slide, an opening in the slide, and an interior of a front end of the slide. In this embodiment, the back wall 51 of the gas port is a continuous wall defined by a front surface of an arch and a back wall of the barrel egress (the arch may be similar in any respect to the arch 21 of FIGS. 2A-B).

Figure 5C:
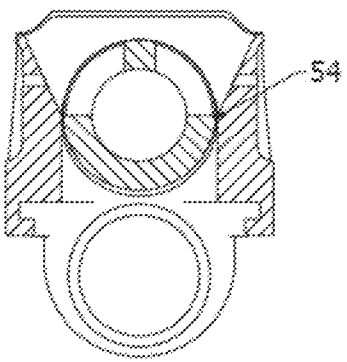
FIG. 5C illustrates a cross-sectional view of the slide of the slide assembly of FIG. 5A taken across a width of the slide assembly.
Figure 5B:
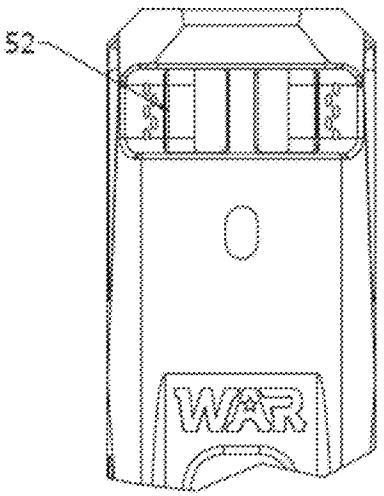
FIG. 5B illustrates a top view of the slide assembly of FIG. 5A.

FIG. 5B illustrates a top view of the slide assembly of FIG. 5A. The sides 52 of the gas port is a continuous wall defined by protrusions on an interior of the slide (the protrusions may be similar in any respect to protrusions 22 of FIGS. 2A-B) and extending to meet up with the bottom edge of the barrel egress of the barrel.

FIG. 5C illustrates a cross-sectional view of the slide assembly of FIG. 5A taken across a width of the slide assembly. In this view, the alignment 54 of the barrel egress to a slide opening geometry is shown.

Figure 5D:
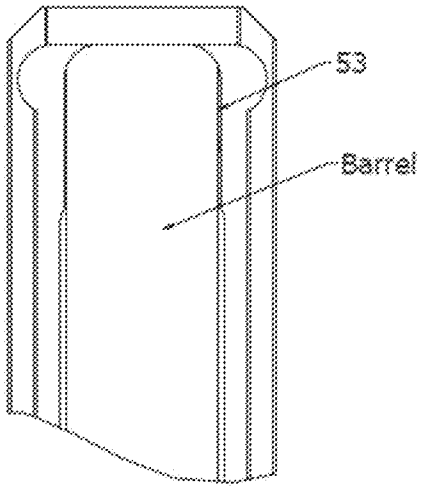
FIG. 5D illustrates a bottom view of the slide assembly.

FIG. 5D illustrates a bottom view of the slide assembly. The protrusions on the interior surface of the sides of the slide may sealingly engage 53 the barrel.

Figure 5E:
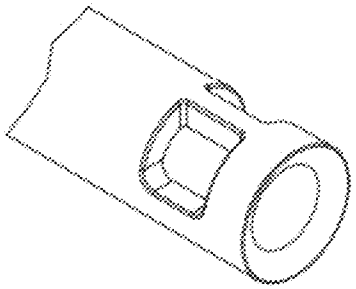
FIG. 5E illustrates a partial side view of the barrel of the slide assembly of FIG. 5A.

FIG. 5E illustrates the barrel of the slide assembly of FIG. 5A. This barrel may be similar in any respect to barrel 300 of FIG. 3. This barrel optionally includes scalloping, which may be visible through a window similar to window 27 (FIG. 2A).

Figure 6A:
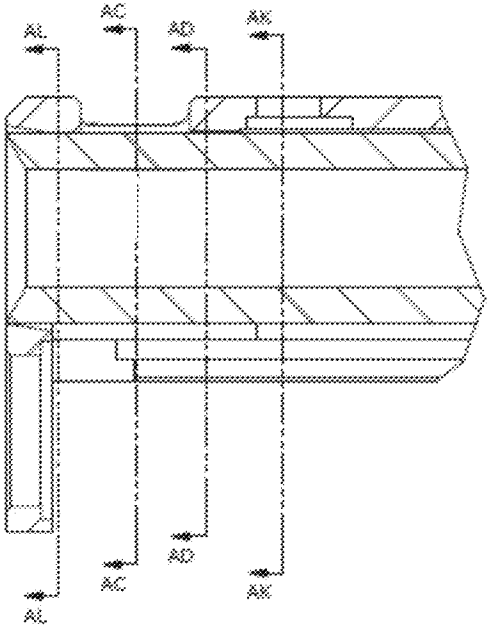
FIG. 6A illustrates a cross-sectional view of a muzzle end of the slide assembly of FIG. 5A taken across a length of the slide assembly.
Figure 6B:
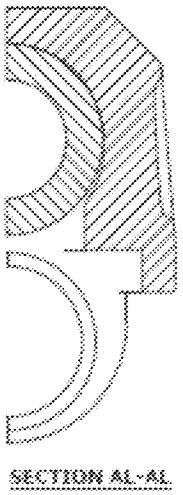
FIG. 6B illustrates a cross-sectional view taken along line AL of FIG. 5A.
Figure 6C:
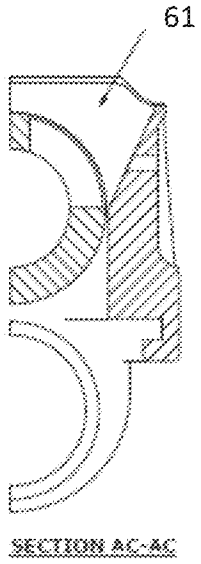
FIG. 6C illustrates a cross-sectional view taken along line AC of FIG. 5A.

FIG. 6A illustrates a cross-sectional view of a muzzle end of the slide assembly of FIG. 5A taken across a length of the slide assembly. FIG. 6B illustrates a cross-sectional view taken along line AL of FIG. 6A. FIG. 6C illustrates a cross-sectional view taken along line AC of FIG. 6A. A gas port 61 formed by an egress in a barrel and an opening in a slide is shown (this gas port may be similar in any respect to any gas port described herein).

Figure 6D:
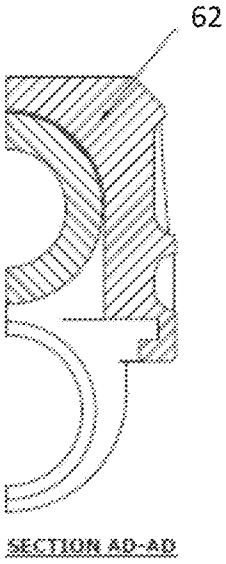
FIG. 6D illustrates a cross-sectional view taken along line AD of FIG. 5A.
Figure 6E:
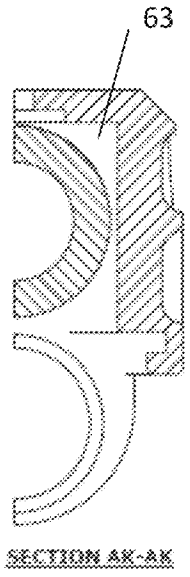
FIG. 6E illustrates a cross-sectional view taken along line AK of FIG. 5A.

FIG. 6D illustrates a cross-sectional view taken along line AD of FIG. 6A. Behind the gas port 61 (FIG. 6C), material 62 of protrusions on an interior of the top and sides of the slide extend toward the barrel. This material 62 may be material of an arch similar to arch 21 of FIG. 2A. FIG. 6E illustrates a cross-sectional view taken along line AK of FIG. 6A. A barrel hood channel 63 is shown in this view.

Figure 16A:
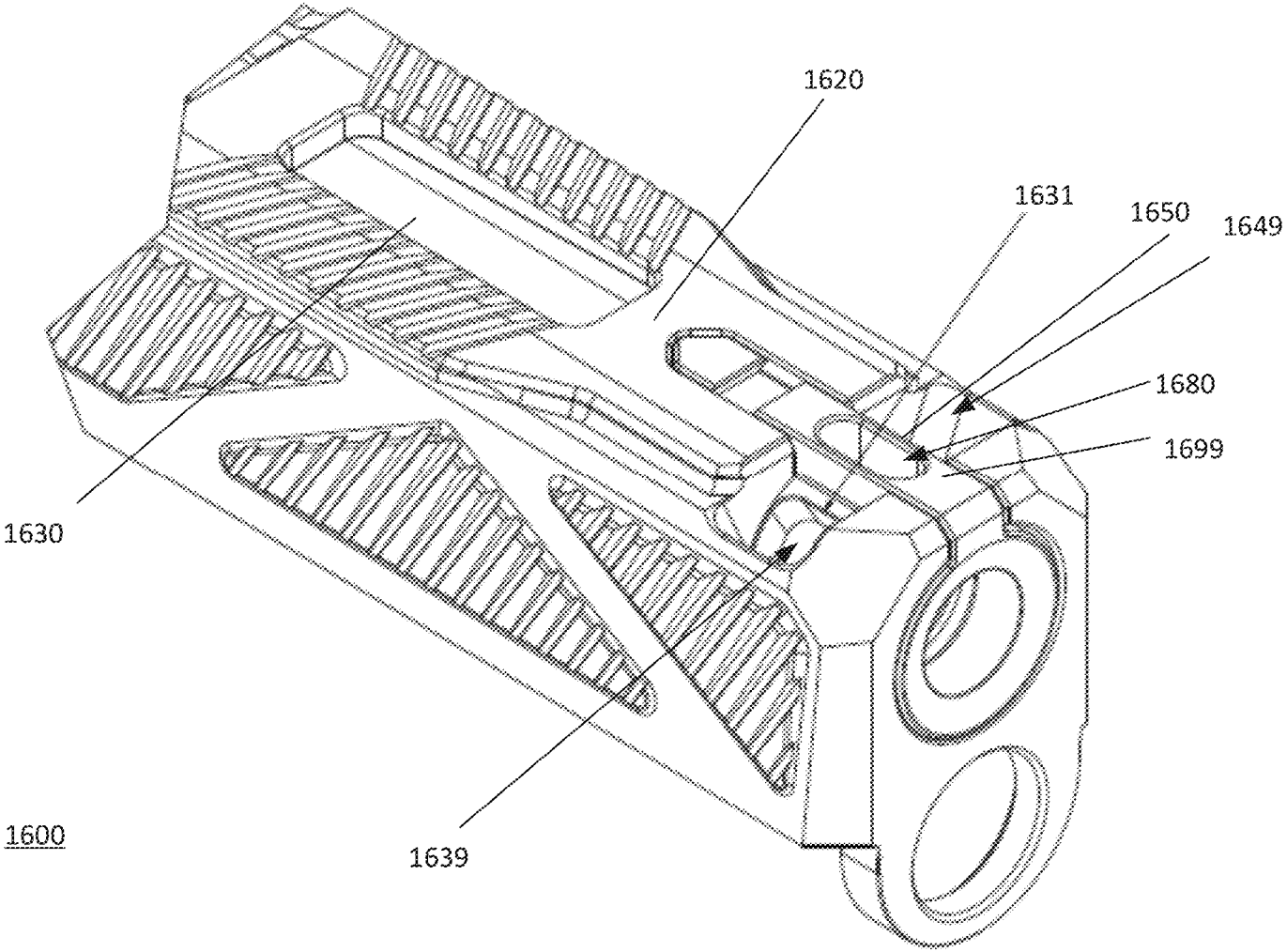
FIGS. 16A-B illustrate partial side views of another embodiment of a slide assembly to provide a firearm with gas compensation to reduce recoil in which the barrel includes a sight tracker.
Figure 16B:
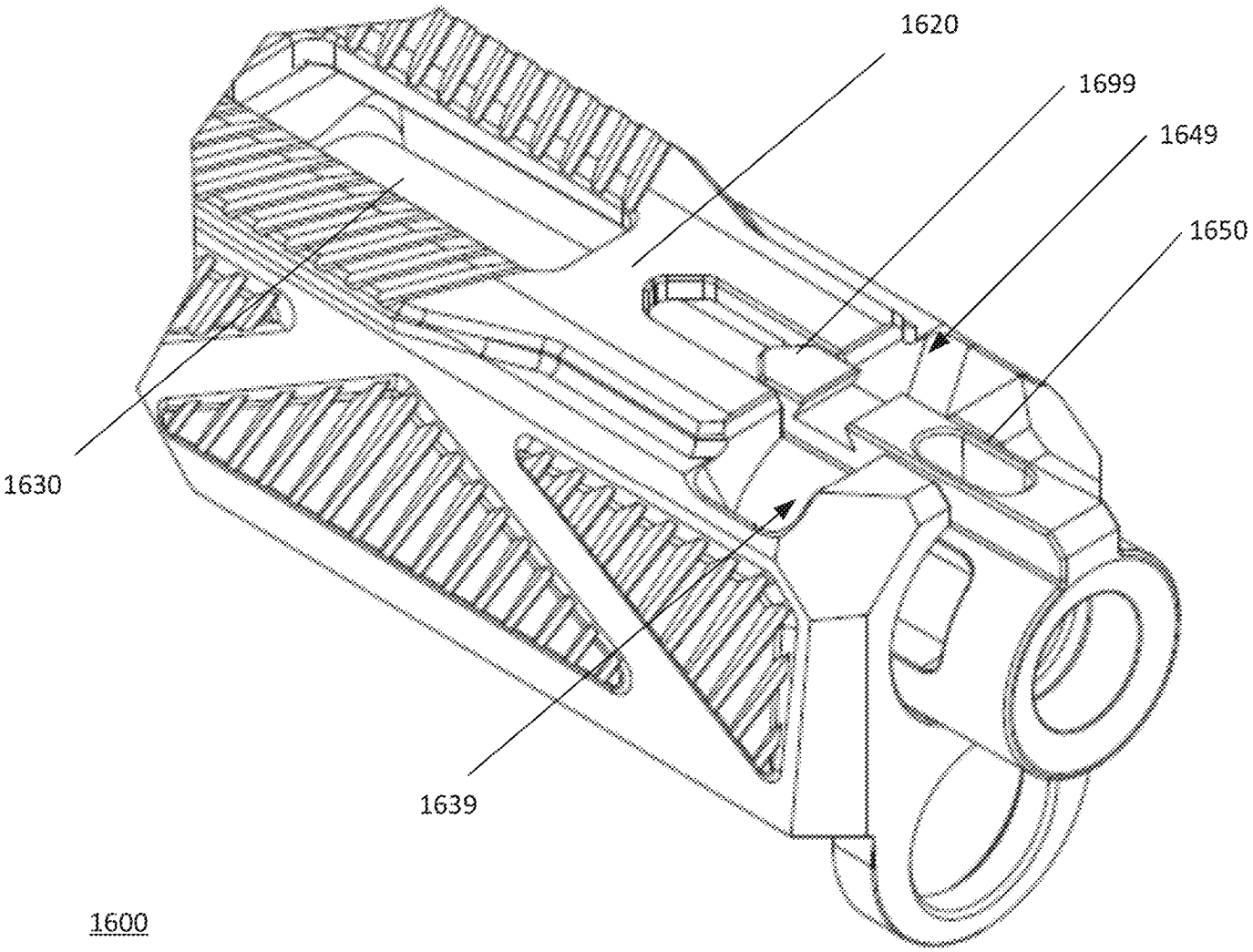

FIGS. 16A-B illustrate a partial side view of another embodiment of a slide assembly 1600 to provide a firearm with gas compensation to reduce recoil in which the barrel 1630 includes a sight tracker 1699. The barrel 1630 is locked with the slide 1620 in the partial side view of FIG. 16A. The partial side view of FIG. 16B shows a state following firing once the slide 1620 has moved relative to the barrel 1630.

Referring again to FIG. 16A, the slide 1620 may be similar to slide 200 (FIG. 2A) in any respect. The barrel 1630 may be similar to barrel 300 (FIG. 3) in any respect. The gas port 1649 may be similar to gas port 49 (FIG. 4A) in any respect. The sight tracker 1699 includes a rib section 1650. In this embodiment of the sight tracker 1699, the sight tracker 1699 defines an additional gas port 1680 (cut through a center of the rib section 1650 and exposing an egress at an uppermost part of the barrel).

As shown in FIG. 16B, a top surface of sight tracker 1699 may protrude from the slide 1620 at least following a firing of the firearm (when the front of the barrel 1630 may rise with respect to the slide 1620). Using the sight tracker 1699, and due to the recoil reduction provided by the gas port 1649, a user may continue tracking a target more easily from one round to the next than in the same firearm without the firearm assembly 1600.

Figure 16C:
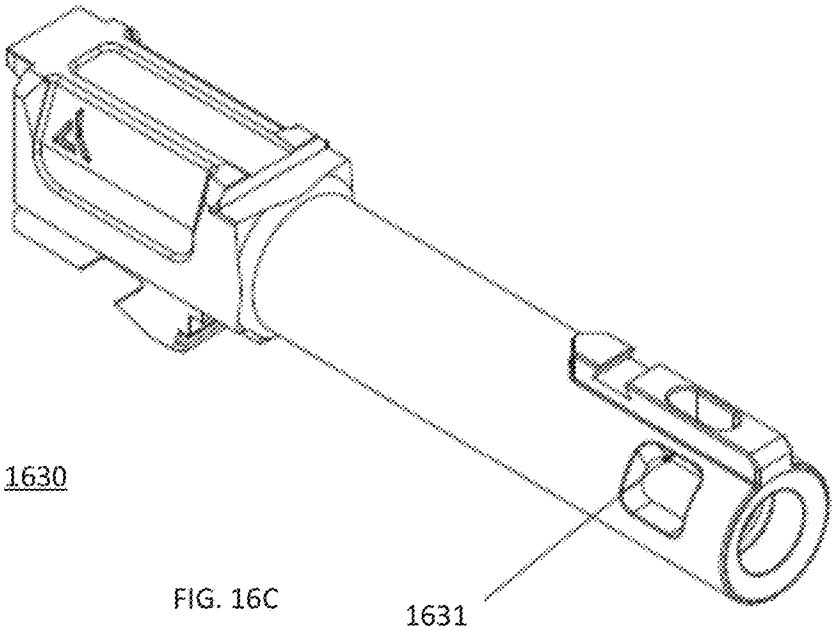
FIGS. 16C-D illustrate perspective and side views (respectively) of the barrel of the slide assembly of FIGS. 16A-B.
Figure 16D:
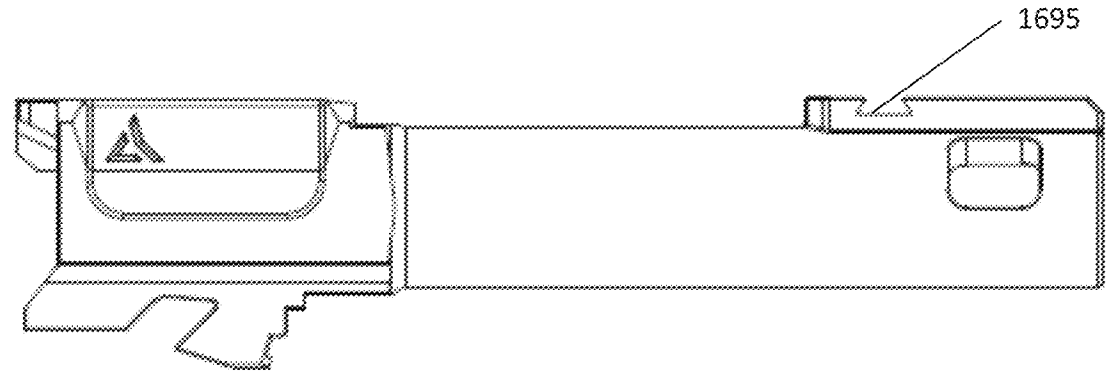

In this embodiment, an arc segment 1631 (FIG. 16A) of the barrel is located between an edge of the egress 1639 and the sight tracker 1699. FIGS. 16C-D illustrate perspective and side views (respectively) of the barrel 1630. The arc segment 1631 is shown in detail in FIG. 16C. In contrast to the sight opening 5 (FIG. 1A) which is in the slide 100, this front sight mount 1695 is part of the barrel. In this embodiment, the front sight mount 1695 is a dovetail groove, but other embodiments may utilize some other channel (or some other structure to mate with a bottom of a front sight). In other embodiments, a front sight and the barrel may be a unitary structure.

Barrel Interior

An egress on a barrel may be deburred to clear a path for the bullet. Also, to prevent stripping material from the bullet, some of the rifling inside the barrel near the muzzle may be removed (which may reduce stripping of the bullet as it passes the egress). Essentially, the muzzle end of the bore may be bored out by a tool inserted into the muzzle end of the barrel to remove rifling of the muzzle end of the bore to reduce or prevent bullet stripping. In one embodiment, the barrel is bored from the muzzle end of the barrel to behind the rear-most edge of the egress 39, e.g., about half a millimeter behind the rear-most edge, to prevent bullet striping. However, this is not required—in other embodiments rifling may be removed from the muzzle end of the barrel to a location corresponding with a front-most edge of the egress 39. However, other approaches are described below, and these approaches may eliminate bullet stripping without requiring removal of the rifling between the muzzle end of the barrel and the location corresponding with either edge of the egress 39.

Figure 7A:
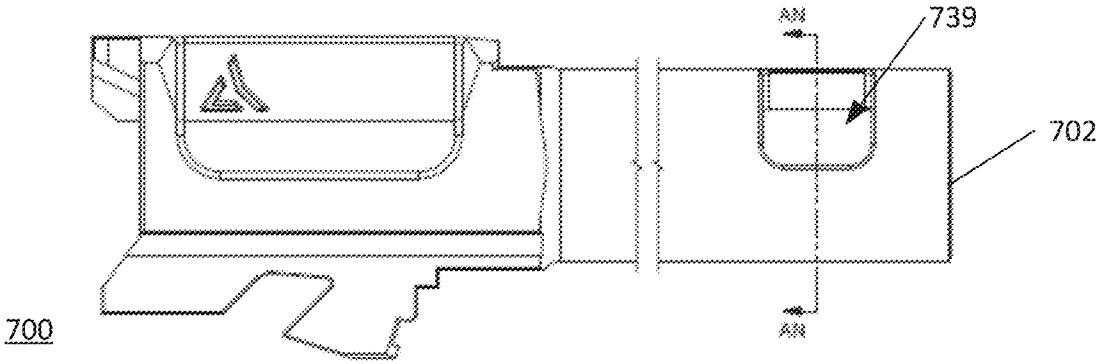
FIG. 7A illustrates a side view of a barrel in which rifling may be preserved between the muzzle end of the barrel and a location coinciding with a front-most edge of the egress.

FIG. 7A illustrates a side view of a barrel 700 in which rifling may be preserved between the muzzle end 702 of the barrel and a location coinciding with a front-most edge of the egress 739. The barrel 700 may be similar in any respect to the barrel described with reference to FIG. 3, or any other barrel described herein.

Figure 7D:
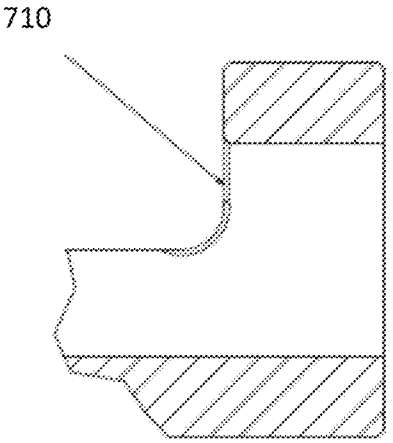
FIG. 7D illustrates a detailed view of the chamfer on a front-most bore edge of the egress.
Figure 7C:
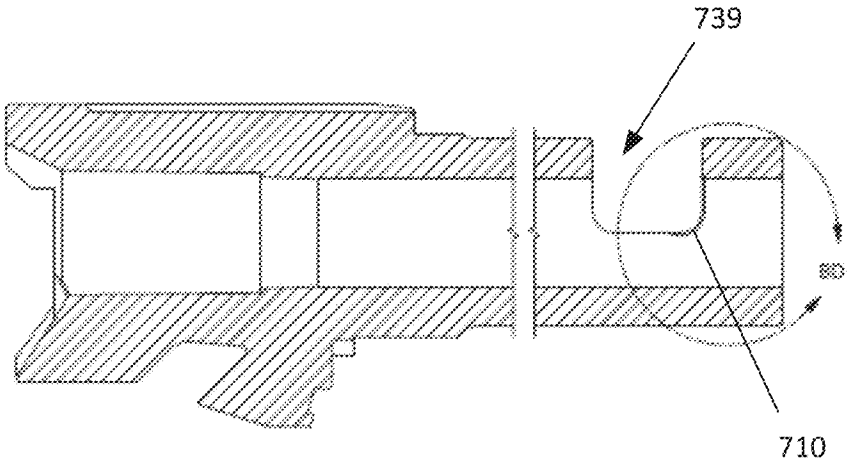
FIG. 7C illustrates a cross-sectional view taken along line BA of FIG. 7B.
Figure 7B:
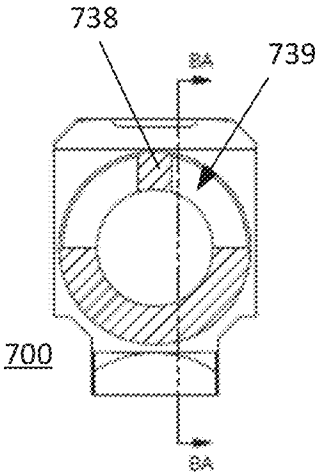
FIG. 7B illustrates a cross-sectional view taken across a width of the barrel of FIG. 7A.

FIG. 7B illustrates a cross-sectional view taken across a width of the barrel 700 of FIG. 7A. In this example, the egress 739 spans a distance from a middle of the side of the barrel to an edge of the rib 738 at the top of the barrel 700. The rifling on the inside of the rib 738 may assist in imparting rotation to the bullet.

FIG. 7C illustrates a cross-sectional view taken along line BA of FIG. 7B. In this view, the chamfer 710 on the bore-edge of the egress 739 is visible. FIG. 7D illustrates a detailed view of the chamfer 710 on a front-most bore-edge of the egress. This chamfer 710 may be provided on an entire front-most bore edge of the egress 739. Other edges may include chamfers, although chamfers are not required on the entirety of the other edges to prevent bullet stripping. The chamfer 710 may be formed by removing material from the egress 739, and then cutting the chamfer 710 on the front-most edge of the egress 739.

FIG. 8A illustrates a side view of another barrel in which rifling may be preserved between the muzzle end of the barrel and a location coinciding with a rear-most or front-most edge of the egress. FIG. 8B illustrates a cross-sectional view taken across a width of the barrel of FIG. 8A. FIG. 8C illustrates a cross-sectional view taken along line BC of FIG. 8B. In this view, the circumferential groove 810 can be seen. The circumferential groove 810 may have sloped sidewalls (e.g., a V-shaped groove) in which the circumferential groove 810 is centered on the front-most edge of the egress 839 (in other examples, the circumferential groove 810 may be centered on the rear-most edge of the egress 839). In some embodiments, circumferential grooves may be centered on the front-most edge of the egress 839 and the rear-most edge of the egress 839, respectively.

Figure 9A:
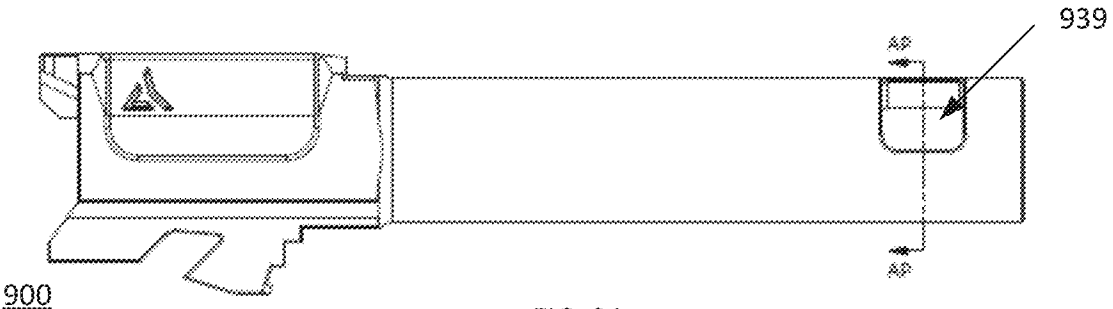
FIG. 9A illustrates a side view of yet another barrel in which rifling may be preserved between the muzzle end of the barrel and a location coinciding with a front-most edge of the egress.
Figure 9C:
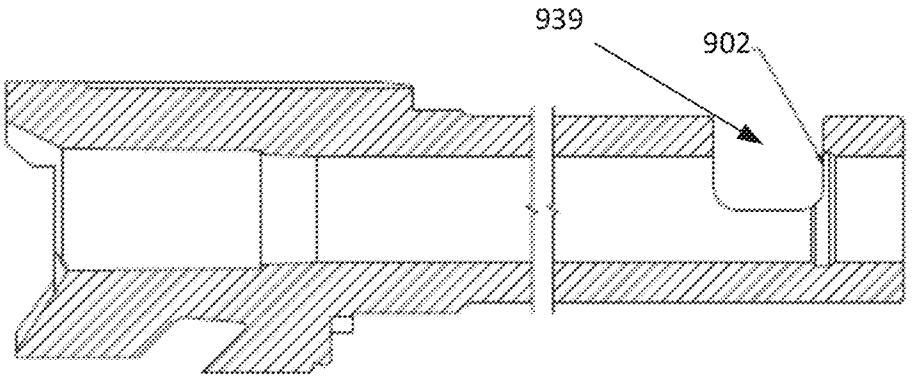
FIG. 9C illustrates a cross-sectional view taken along line AY of FIG. 9B.
Figure 9B:
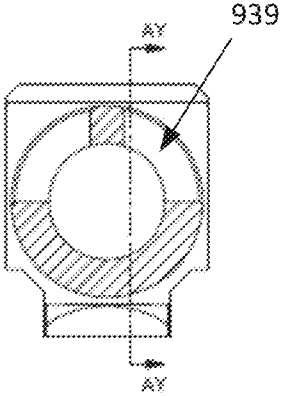
FIG. 9B illustrates a cross-sectional view taken across a width of the barrel of FIG. 9A.

FIG. 9A illustrates a side view of yet another barrel in which rifling may be preserved between the muzzle end of the barrel and a location coinciding with a rear-most or front-most edge of the egress. FIG. 9B illustrates a cross-sectional view taken across a width of the barrel of FIG. 9A. FIG. 9C illustrates a cross-sectional view taken along line AY of FIG. 9B. In this view, the circumferential groove 910 can be seen. The circumferential groove 910 may have sloped sidewalls (e.g., sidewalls similar to circumferential groove 810 of FIG. 8C) and additionally may have a bottom width between bottoms of the sidewalls.

In one example, the bottom width may be a flat bottom, although this is not required. The circumferential groove 910 need not necessarily be centered on the front-most or rear-most bore-edge of the egress 939. This may improve manufacturing tolerances as compared to the chamfer 710 or the V-shaped circumferential groove. The front-most or rear-most edge of the egress may coincide with any portion of the bottom width.

Alignment System to Control Movement of a Barrel Relative to a Slide

Figure 10A:
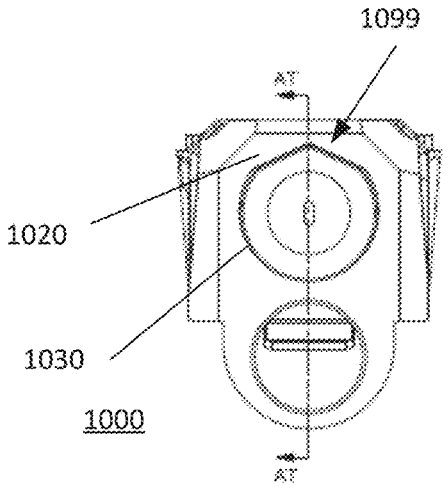
FIG. 10A illustrates a cross-sectional view taken across a width of a slide assembly with an alignment system to restrict movement of the muzzle end of the barrel within a plane perpendicular to a bore axis of the barrel and prevent rotational movement of the barrel relative to the slide.

FIG. 10A illustrates a cross-sectional view taken across a width of a slide assembly 1000 with an alignment system 1099 to restrict movement of the muzzle end of the barrel 1030 within a plane perpendicular to a bore axis of the barrel 1030 and prevent rotational movement of the barrel 1030 relative to the slide 1020. The bore axis is the center of a bore extending from a start of the bore to the muzzle end of the bore (in this view, the bore axis is at a center of the bore of the barrel 1030 going into the page, and the plane coincides with the page).

The alignment system 1099 includes a groove or protrusion located on the bore length segment of the barrel 1030. This groove or protrusion mates with a protrusion or groove defined by an interior surface of the slide. In this embodiment, the bore length segment of the barrel 1030 is non-cylindrical, and the alignment system 1099 includes a protrusion on a top of the barrel 1030 (e.g., the pointed top of the non-cylindrical bore length segment). In this embodiment, the protrusion mates with a groove defined by an underside of a top of the slide 1020. The alignment system 1099 reduces lateral movement of the muzzle end of the barrel 1030 within the plane (e.g., prevents movement of the barrel to the left or right).

Figure 10B:
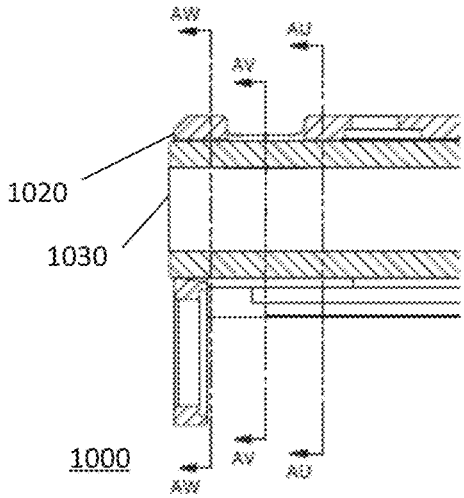
FIG. 10B illustrates a cross-sectional view taken across a width of the slide assembly of FIG. 10A.
Figure 10C:
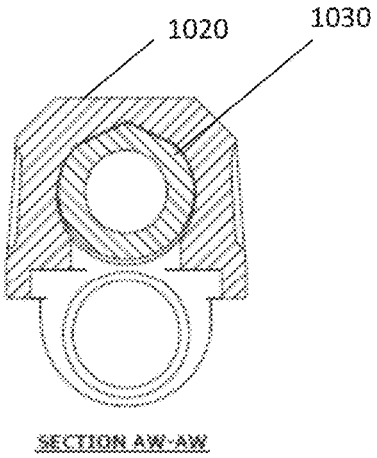
FIG. 10C illustrates a cross-sectional view taken along line AW of FIG. 10B.
Figure 10D:
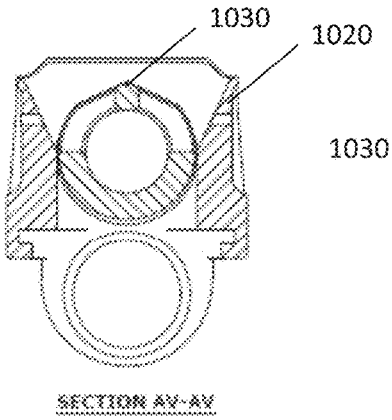
FIG. 10D illustrates a cross-sectional view taken along line AV of FIG. 10B.
Figure 10E:
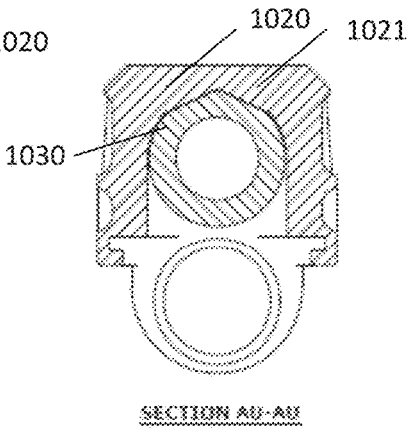
FIG. 10E illustrates a cross-sectional view taken along line AU of FIG. 10B.

FIG. 10B illustrates a cross-sectional view taken across a width of the slide assembly of FIG. 10A. FIG. 10C illustrates a cross-sectional view taken along line AW of FIG. 10B. FIG. 10D illustrates a cross-sectional view taken along line AV of FIG. 10B. FIG. 10E illustrates a cross-sectional view taken along line AU of FIG. 10B. FIGS. 10C-E illustrate that the slide assembly 1000 provides gas compensation to reduce recoil. In particular, an arch 1021 is shown in FIG. 10E, and this arch may be similar in any respect to arch 21 (FIG. 2A).

The arch 1021 includes a triangular shaped underside, in contrast to the rounded underside of the arch 21 (which does not include the alignment system 1099). Other examples including of slide assemblies to provide gas compensation to reduce recoil and with an alignment system may have differently shaped arches (for instance, it may be possible and practical to have a protrusion from an underside of the arch to mate with a groove formed on an upper section of a non-cylindrical barrel).

Also, some embodiments of a slide assembly that do not provide gas compensation to reduce recoil may utilize an alignment system similar to alignment system 1099. Such an embodiment may not include an arch similar to arch 21 (FIG. 2A) or arch 1021. However, an underside of the slide in such an embodiment may include the protrusion or groove on an underside of a front of the slide (e.g., a non-cylindrical opening in the front of the slide to receive a non-cylindrical bore length segment of a barrel). Accordingly, various embodiments of a slide assembly may include gas compensation and/or an alignment system.

Slide Assembly with Optic Mounting Platform

Pistols may be retrofitted with a red dot sight using an MOS (modular optic system) using a mount bracket located behind the ejection port. FIG. 1B illustrates a partial top view of a slide with an MOS (modular optic system) cover plate removed. The slide 150 may otherwise be similar to the slide 100 (FIG. 1A). FIG. 1C illustrates a bottom view of an MOS adapter plate 151 (the MOS adapter plate is an intermediary interface to couple to an optic adapter mounting interface—other optic adapter mounting interfaces exist). FIG. 1D illustrates a slide assembly 152 in which the MOS adapter plate 151 of FIG. 1C is installed on the slide of FIG. 1B.

FIG. 1E illustrates installation of a sealing plate 153 on the slide assembly 152 of FIG. 1D. The sealing plate 153 may be made out of thin sheet metal. The sealing plate 153 may have a width that is the same as a width of a bottom of an RMR optic 154 (FIG. 1F illustrates a bottom view of an RMR optic 154), both of which may be wider than the MOS adapter plate 151 (FIG. 1C). The sealing plate 153 forms a seal with a seal 156 to prevent moisture from reaching the battery 155. FIG. 1G illustrates the RMR optic 154 of FIG. 1F and the sealing plate 153 of FIG. 1E installed on the slide assembly of FIG. 1D.

Figure 11A:
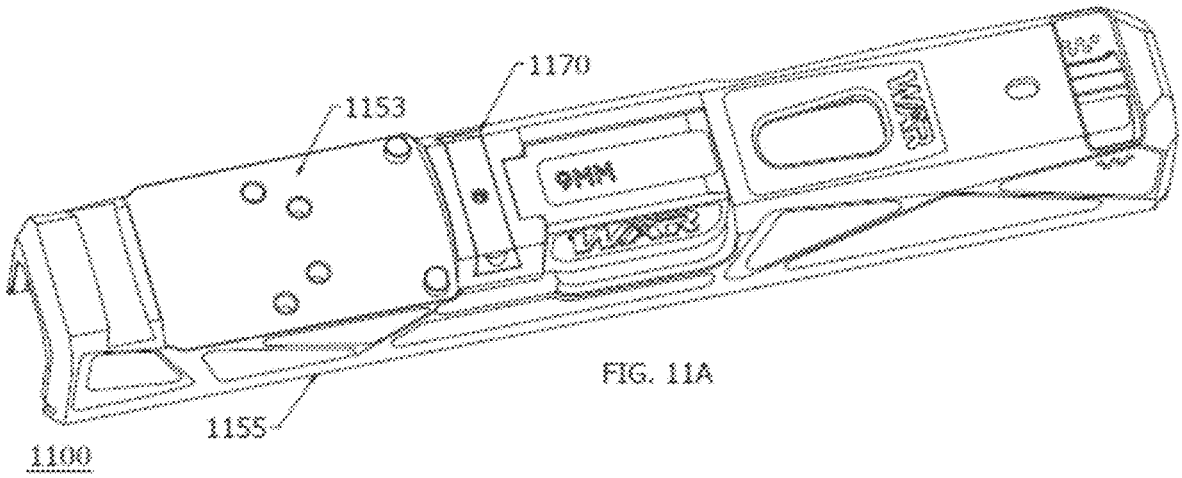
FIG. 11A illustrates a partial top view of a slide assembly including an optic mounting platform integrally formed on the top of the slide and a grip for charging the slide integrally formed from sides below the optic mounting platform.
Figure 11B:
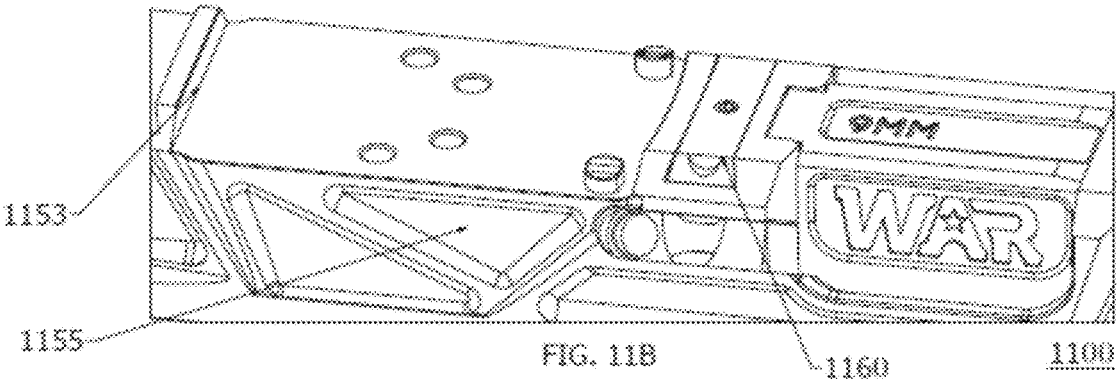
FIG. 11B illustrates a partial side view of the slide assembly of FIG. 11A.
Figure 11C:
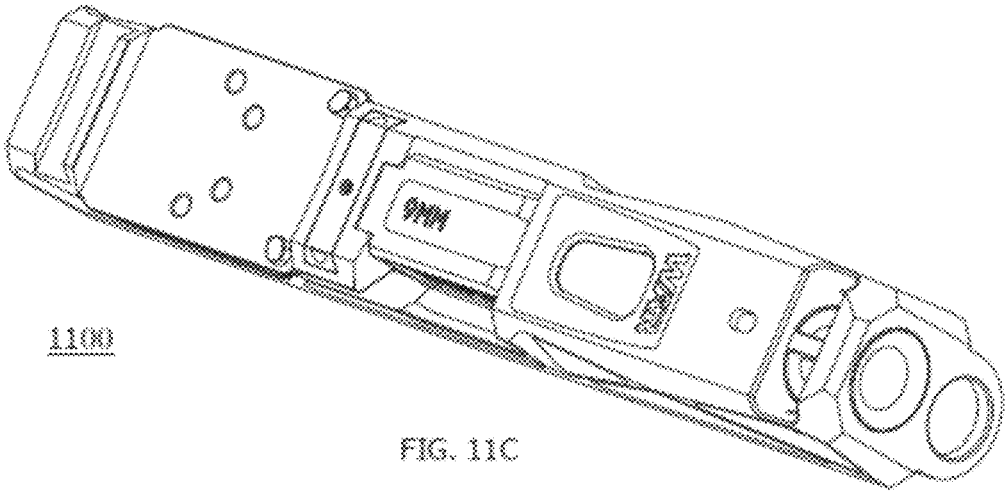
FIG. 11C illustrates the slide of FIGS. 11A-B being charged using the grip that is integrally formed from the sides below the optic mounting platform.

FIG. 11A illustrates top and side views of a slide 1100 including an optic mounting platform 1153 integrally formed on the top of the slide 1100 and a grip for charging the slide integrally formed from sides 1155 below the optic mounting platform 1153. FIG. 11B illustrates a partial side view of the slide 1100 of FIG. 11A. FIG. 11C illustrates the slide 1100 of FIGS. 11A-B being charged using the grip that is integrally formed from the sides 1155 below the optic mounting platform 1153.

Figure 13:
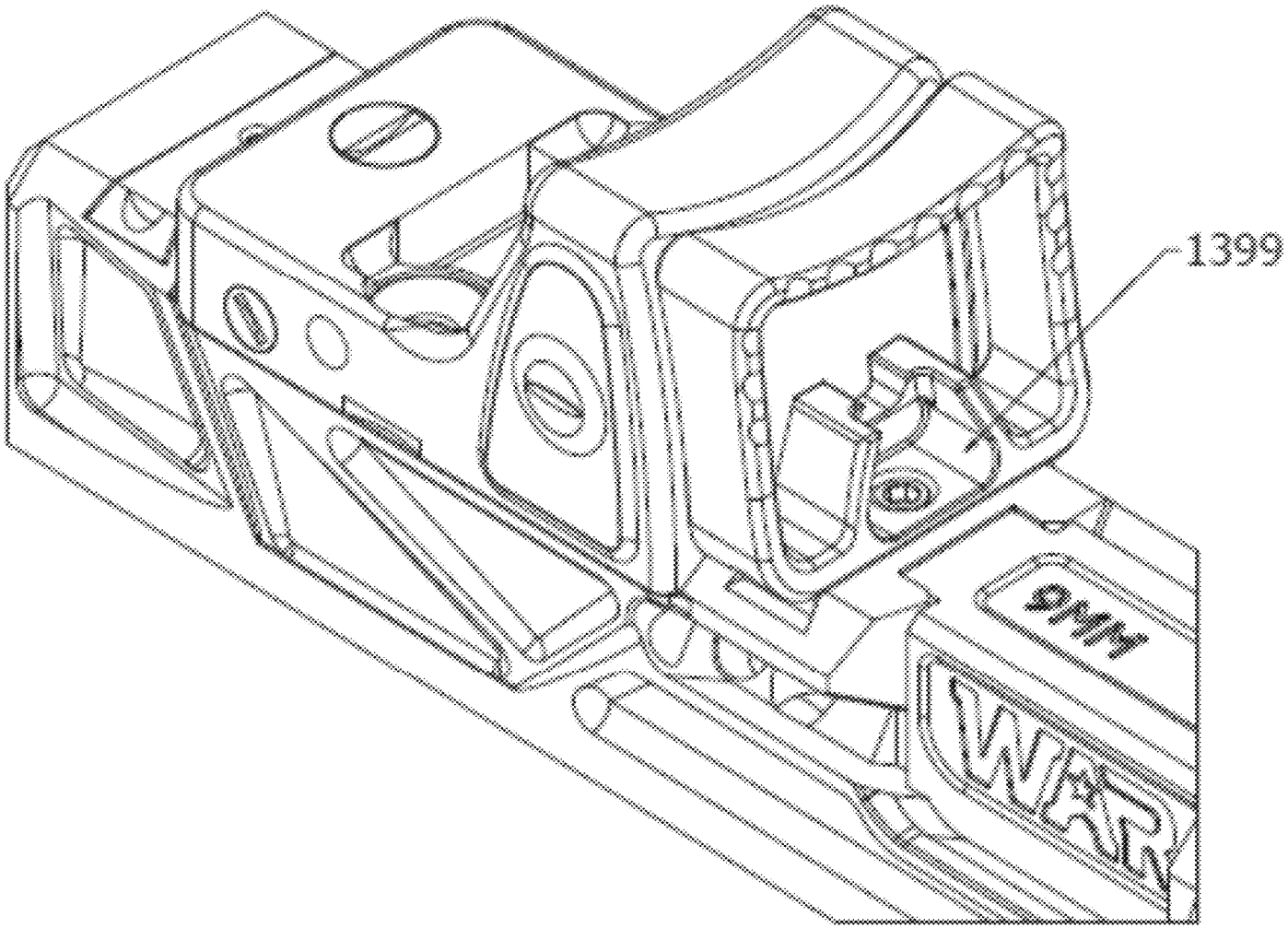
FIG. 13 illustrates a partial side view of an optic guard with an integrated rear sight.

Referring to FIG. 11A, in this embodiment, the width of the optic mounting platform 1153 corresponds to the width of the RMR optic 154 (FIG. 1F). FIG. 13 illustrates a partial side view of a slide assembly in which the RMR optic 154 illustrated in FIG. 1F is mounted directly on the slide 1100, and in which the sides of the RMR optic 154 align with sides of the optic mounting platform 1153. Other embodiments may be arranged for use with some other optic, and the sides of the optic mounting platform 1153 align with the sides of the optic.

Referring again to FIG. 11A, the RMR optic 154 may mount directly on the optic mounting platform 1153. The optic mounting platform 1153 includes a smooth surface to form a seal with the seal 156 (FIG. 11C) of the RMR optic 154 in the case of direct mounting. In some embodiments, a distance between a surface of the optic mounting platform 1153 and the top of the RMR optic 154 may be less than a distance between a top of the slide 150 (FIG. 1B) and the RMR optic 154, reducing the height of the firearm assembly.

In this embodiment, the optic mounting platform 1153 is a recess in a top of the slide 1100. In particular, material is removed from the top of the slide 1100 to form the surface of the optic mounting platform. In this embodiment, the surface of the optic mounting platform 1153 is lower than a top of the slide 1100 in front and/or behind the optic mounting platform 1153. As such, a distance between the surface of the optic mounting platform and the top of the RMR optic 154 may be less than a thickness of a stack including the MOS adapter plate 151 (FIG. 1C) and/or the sealing plate 153 (FIG. 1E). In other embodiments, the optic mounting platform 1153 may be formed using other techniques besides recessing a top of the slide. Whether or not recessing is used, in various embodiments the surface of the top of the optic mounting platform 1153 may be arranged to be no greater than surfaces of a top of the slide in front and/or behind the optic mounting platform 1153 (e.g., lower than or coplanar with the surfaces of the top of the slide in front and/or behind the optic mounting platform 1153).

The sides of the slide 150 (FIG. 1B) include scalloping to grip the vertical sidewalls of the slide 150 to charge the slide 150. However, when the slide gets wet and/or if the user does not grip the slide optimally (say, due to an injury), the user's grip may slip before completely charging the slide.

Referring to FIG. 11A, the sides 1155 slope inward from an edge of the optic mounting platform 1153 to a lower location on the sides 1155. This provides an increasing width of the slide 1100 towards the optic mounting platform 1153). This increasing width gives the user leverage when gripping the slide 1100 to compensate for non-optimal conditions (e.g., wet equipment, or an injured hand).

In this embodiment, the inward slope is a continuous linear slope. In other embodiments, the sides 1155 may have a non-linear slope and/or may have varying slopes (for instance two or more slopes may be used to provide an angular surface). In various embodiments, the sides 1155 may have indentions (such as the scalloping of the slide 150 in FIG. 1B or some other indentation such as the triangular depression shown in FIG. 13) or bumps, as desired, to optimize the leverage associated with this grip point.

Figure 11D:
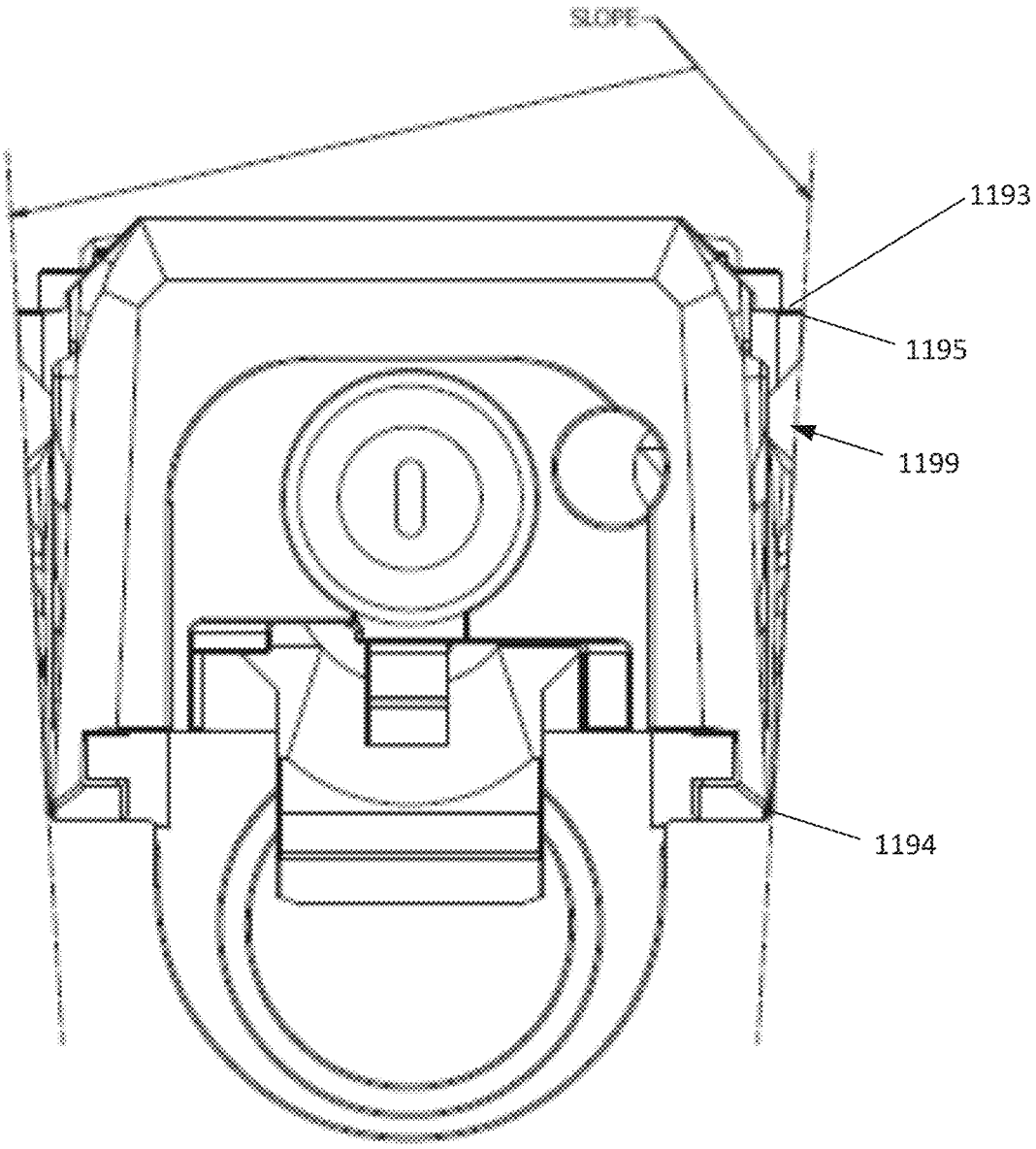
FIG. 11D illustrates a back view of a slide assembly in an embodiment in which the exterior sides of the slide are inward sloping from an upper location below the optic mounting platform to a lower location below the upper location.

FIG. 11D illustrates a back view of a slide assembly in an embodiment in which the exterior sides of the slide are inward sloping from an upper location 1195 below the optic mounting platform 1193 to a lower location below the upper location 1194. Optic mounting platform 1193 may be similar in any respect to optic mounting platform 1153 (FIG. 11A).

In this embodiment, a relief cavity 1199 is created by removing some material from a portion of the inward sloping exterior side. Other examples may not include the relief cavity 1199. Another embodiment may use a continuous non-linear slope. In yet other embodiments, the exterior sides may include varying slopes (linear slopes, non-linear slopes, or combinations thereof).

Figure 11E:
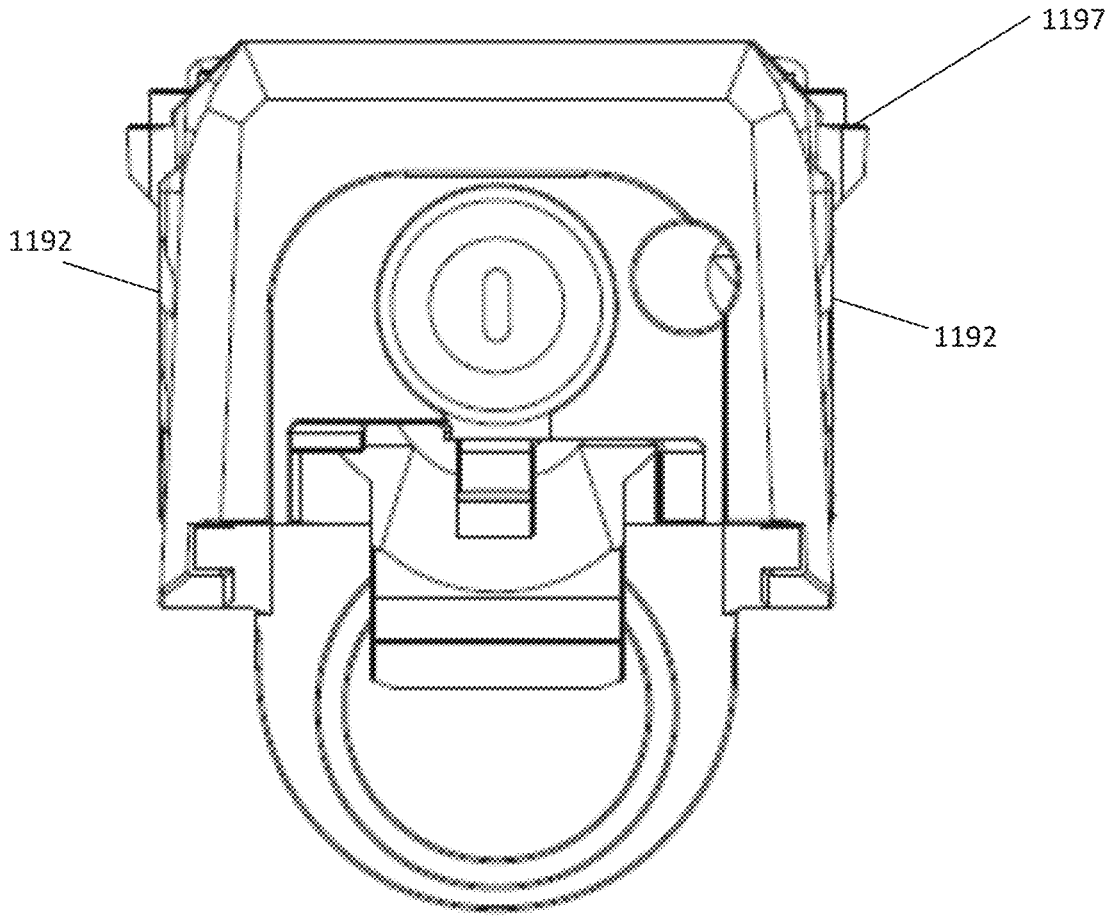
FIG. 11E illustrates a back view of a slide assembly in another embodiment including an optical mounting platform overhanging completely vertical exterior surfaces of sides of the slide.

FIG. 11E illustrates a back view of a slide assembly in another embodiment including an optical mounting platform 1197 overhanging fully vertical exterior surfaces 1192 of sides of the slide. The optical mounting platform 1197 may be similar to optical mounting platform 1193 (FIG. 11D) in any respect. In this embodiment, an upper portion of the exterior surface of the sides of the slide has two different inward slopes above the fully vertical exterior surface 1192. In other embodiments, there may be a single continuous slope above fully vertical exterior surfaces 1192 (and this single continuous slope may be linear or non-linear). In other embodiments, there may be no inward sloping (e.g., the sidewall section above fully vertical exterior surfaces 1192 may include only one or more fully horizontal sections and one or more fully vertical sections, e.g., one or more "steps").

Optic Guard

Referring again to FIG. 11A, this embodiment of the slide 1100 includes an optic guard mount 1170 in front of the optic mounting platform 1153. In this embodiment, the optic guard platform 1153 is integrally formed with the slide 1100 (e.g., integrally formed with the top and/or sides 1155 of the slide 1100). In this embodiment, the optic guard mount 1170 is a channel (e.g., a dovetail groove). A plug 1160 is shown installed in the dovetail groove in FIG. 11B. In other embodiments, an optic guard mount similar to optic guard mount 1170 may be provided in a firearm assembly that may or may not include the optic mounting platform 1153.

Figure 12:
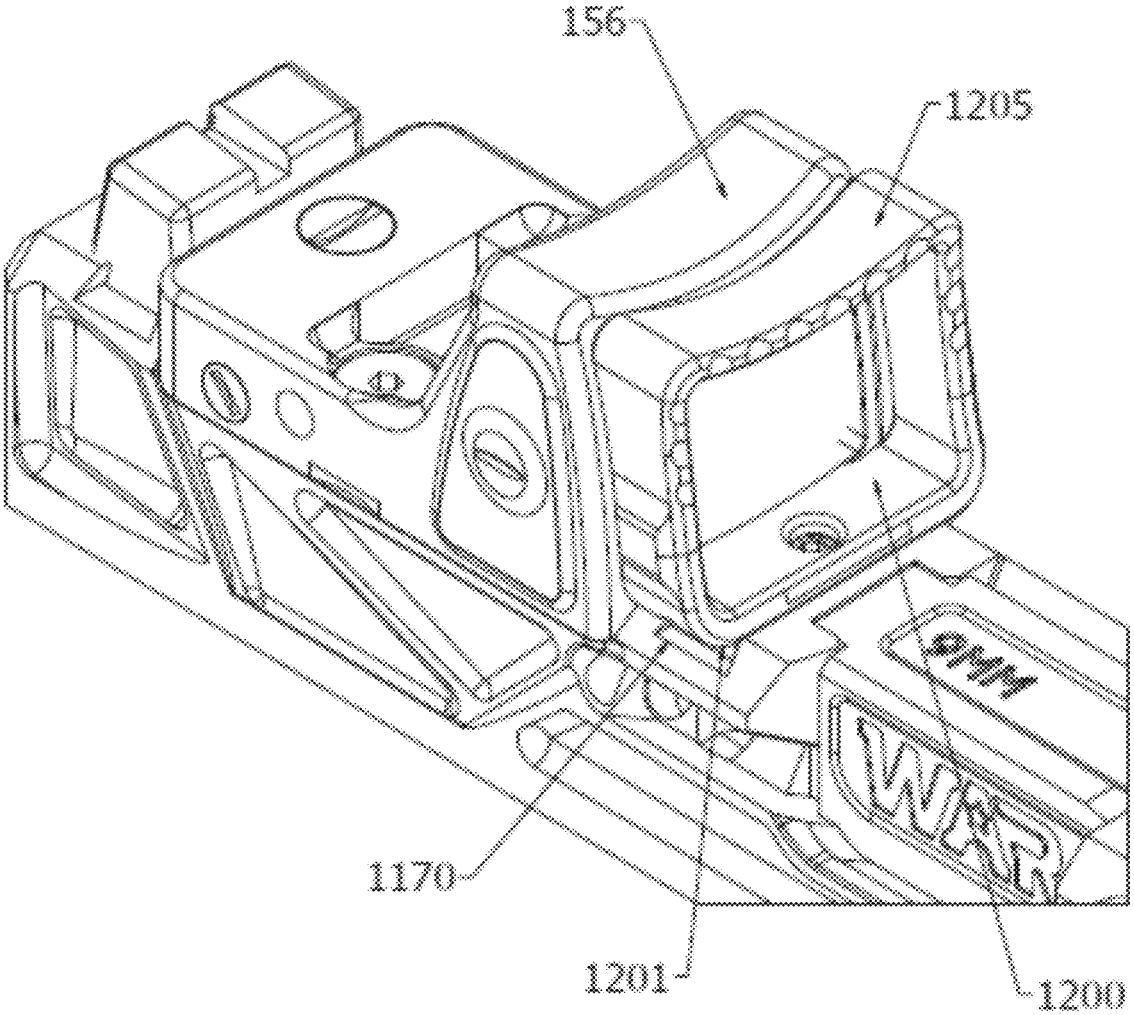
FIG. 12 illustrates a partial side view of a slide assembly in which the RMR optic illustrated in FIG. 1F is mounted directly on the slide illustrated in FIGS. 11A-C.

Referring to FIG. 12, an optic guard 1200 is shown installed in the optic guard mount 1170. The optic guard 1200 includes an integrated bracket 1201 with a first side to mate with the optic guard mount 1170. In this example, a frame 1205 is integrally formed with the bracket 1201, but in other examples the bracket 1201 may have a second opposite side to receive the frame 1205 and the frame 1205 may be attached (e.g., welded, removably attached, or the like) to the second side of the bracket 1201. In this embodiment, the frame 1205 protects a lens of the RMR optic 154, and a housing of the RMR optic 154 (e.g., the housing on the optic mounting platform 1153). The frame 1205 may protect the top and sides of the housing of the RMR optic 154.

In this embodiment, the bracket 1201 couples to a firearm assembly independently of the housing of the RMR optic 154. In the present embodiment, the bracket 1201 couples directly to a firearm. In another embodiment, the bracket 1201 (or any other optic guard bracket described herein) may couple to the firearm assembly by piggyback-mounting to an optic that is mounted on the firearm. For example, the firearm assembly may include a long range optic mounted on the firearm and a short range optic mounted on the long range optic, the bracket 1201 may couple to an optic guard mount defined by a component of the long range optic.

In this embodiment, the optic guard 1200 is arranged to couple to the firearm assembly without contacting the optic and without contacting the housing thereof (e.g., in this embodiment—without contacting any part of the RMR optic 154). A gap between a back of the frame 1205 and the housing of the RMR optic 154 is shown. The gap also prevents impact to the optic guard 1200 from transferring energy to the RMR optic 154—reducing risk of damage to the optic (and also maintaining zero of the sight alignment).

The RMR optic 154 may be sighted in at a time of installation of the optic guard 1200. The arrangement of the optic guard mount 1170 may provide for installation without any contact between the optic guard 1200 and, in this example, any part of the RMR optic 154. For instance, the dovetail groove embodiment of the optic guard mount 1170 allows the optic guard 1200 to be side-installed to maintain zero of the slight alignment of the firearm assembly (no contact with RMR optic 154 during installation).

In the illustrated embodiment, the frame 1205 is fully-enclosed—it includes a top frame segment, a bottom frame segment, and side frame segments (e.g., four sided). In other examples, a frame of on optics guard may have a fewer or greater number of sides (such as a ring shape) and/or be fully and/or substantially enclosed to protect a top and sides of a housing of an optic.

A front of at least one frame segment of the frame segments may include indentations/bumps forming another grip location for charging the slide (the indentations/bumps may also be provided on other frame members, such as on a top part of the front of the side frame segments). One embodiment of the frame 1205 is similar to the frame of the optic guard bracket shown in FIG. 15 (in which indentations are provided on the frame members of the optic guard bracket illustrated in FIG. 15). Charging using this grip location may be performed using the palm of the hand, as illustrated in FIG. 14D. Due to the gap and the depth of the frame 1205, charging using this grip location may not smudge the optic (and as already mentioned may maintain zero).

FIG. 13 illustrates a partial side view of an optic guard with an integrated rear sight 1399. This optic guard may be similar in any respect to optic guard 1200 (FIG. 12). In this embodiment, the integrated rear sight 1399 is located on a bottom member of the frame of optic guard 1200. In another embodiment, the integrated rear sight 1399 may be provided on some other part of the optic guard 1200. In some embodiments, the integrated rear sight 1399 may be releasably coupled to the optics guard 1200. The integrated rear sight 1399, and the charging grip points, are usable regardless of whether the firearm is currently provisioned with an optic or not.

Figure 14A:
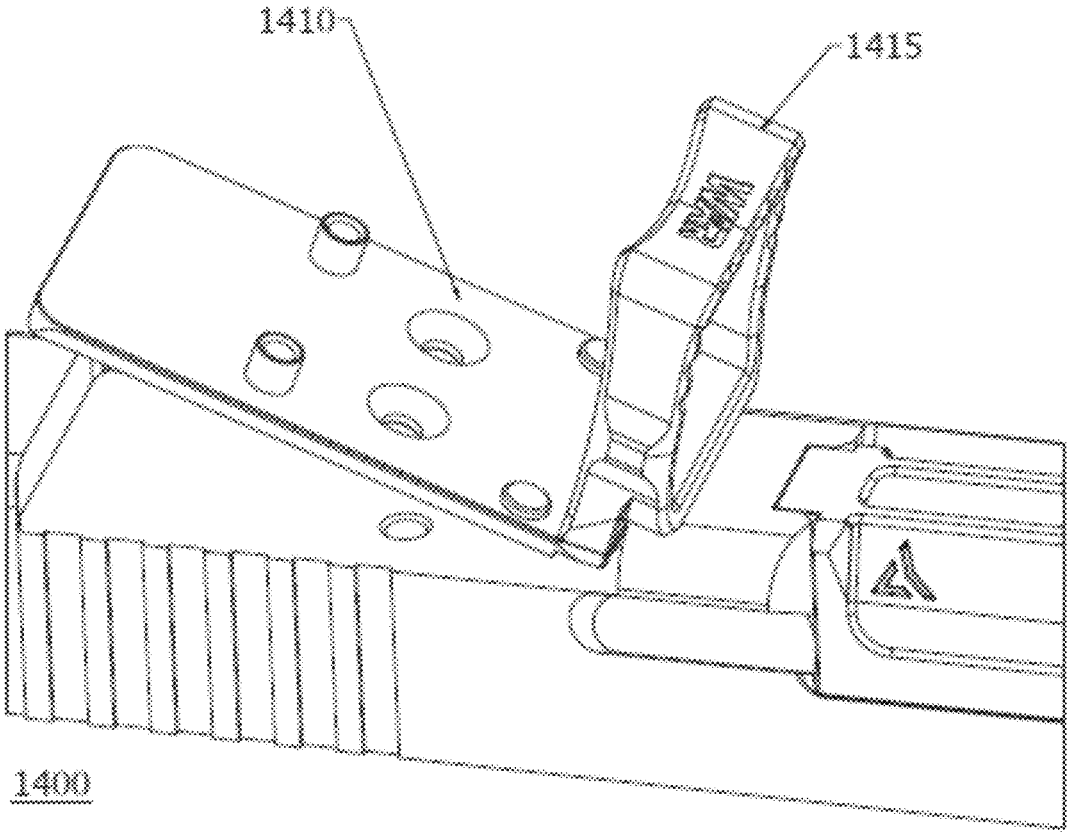
FIG. 14A illustrates a side view of an optic guard usable with the slide and the optic shown in FIG. 1F.
Figure 15:
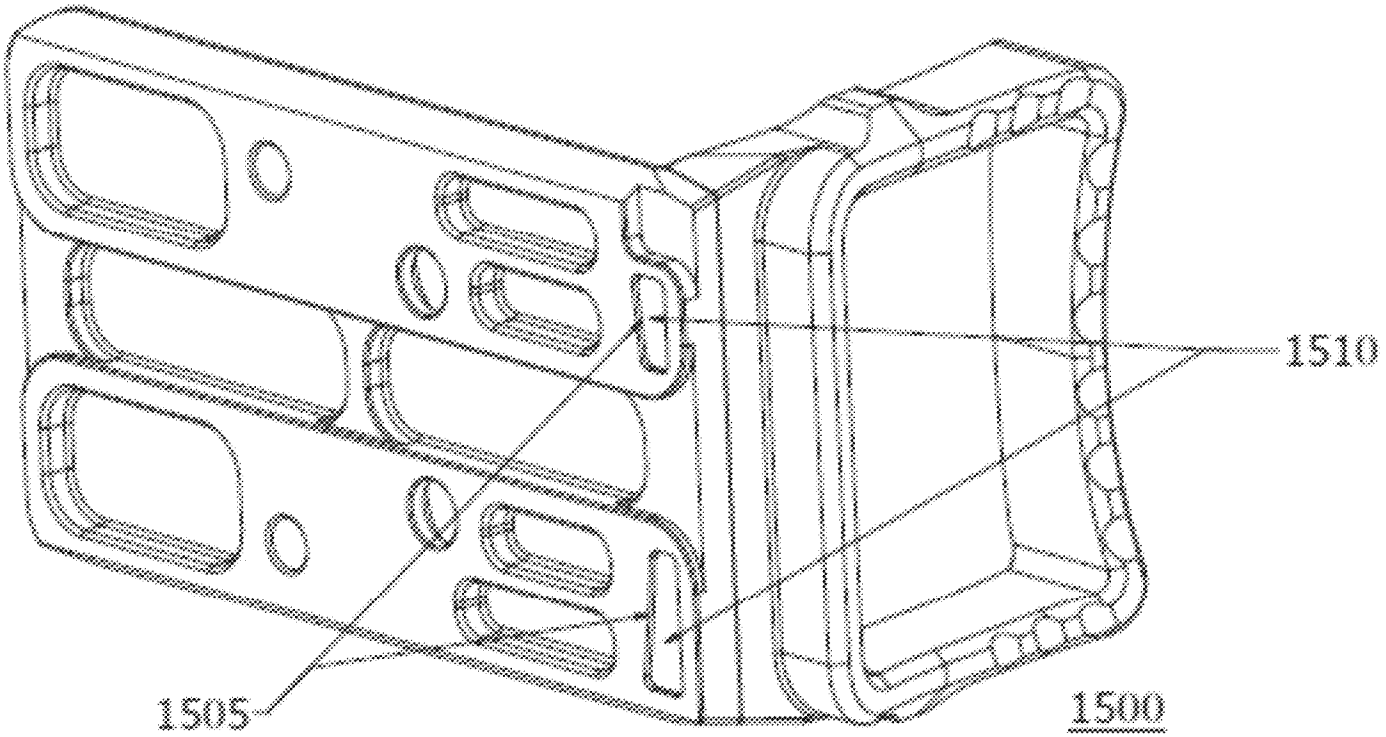
FIG. 15 illustrates an optic guard including a frame welded to a bracket.

FIG. 14A illustrates a side view of an optic guard 1400 usable with the slide 100 and the RMR optic 154 shown in FIG. 1F. This optic guard 1400 includes a frame 1415 (which may be similar in any respect to the frame 1205 of FIG. 12). The frame 1415 is fixably attached to a front of a bracket 1410. Fixable attachment may be welding one or more protrusions on the front of the bracket 1410 or the frame 1415 into mating openings formed on the other of the front of the bracket 1410 and the frame 1415 (e.g., non-releasably attached). FIG. 15 illustrates another embodiment of an optic guard 1500 usable on a legacy slide in which the optic guard 1500 has a fully-enclosed frame fixably attached to a bracket in which the front-most openings 1505 on the bottom of the front of the bracket expose protrusions 1510 extending from the bottom of the frame.

Referring again to FIG. 14A, in this embodiment the bracket 1410 is a plate. However, in other embodiments, a bracket need not be a plate (this is shown in FIG. 15, in which the bracket has a front section that is thicker than a rear section of the bracket).

Figure 14B:
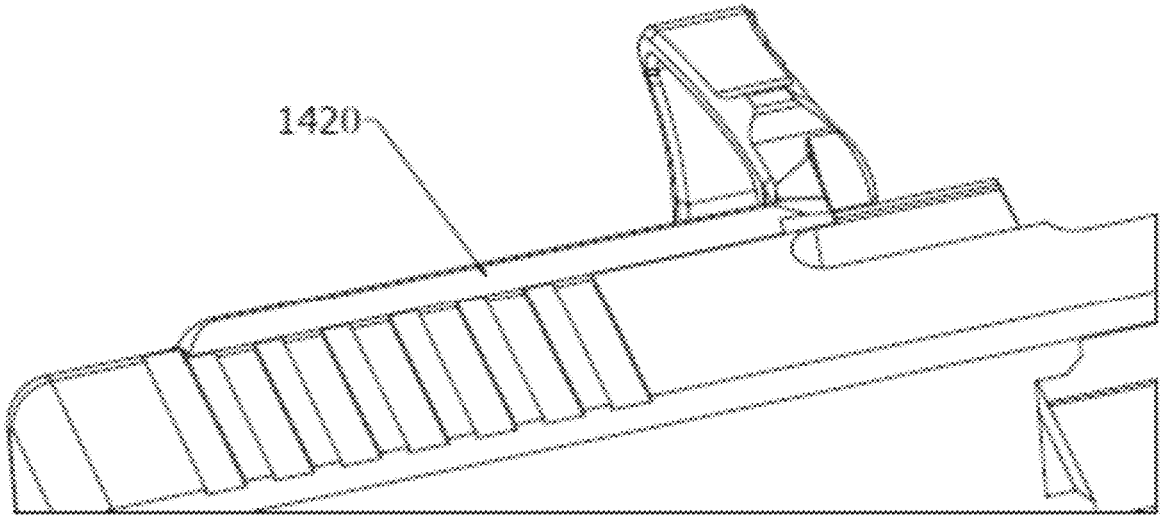
FIG. 14B illustrates a partial side view of a firearm including the optic guard of FIG. 14A installed thereon.

Referring again to FIG. 14A, a surface of the top side of the bracket 1410 may be similar in any respect to the surface of the mounting platform 1153 (FIG. 11A). The bottom side of the bracket 1410 may be smaller than the top side, and may similar to the bottom of the MOS adapter plate 151 (FIG. 1C). FIG. 14B illustrates that the sides 1420 of the bracket 1410 may be sloped, although this is not required.

Figure 14C:
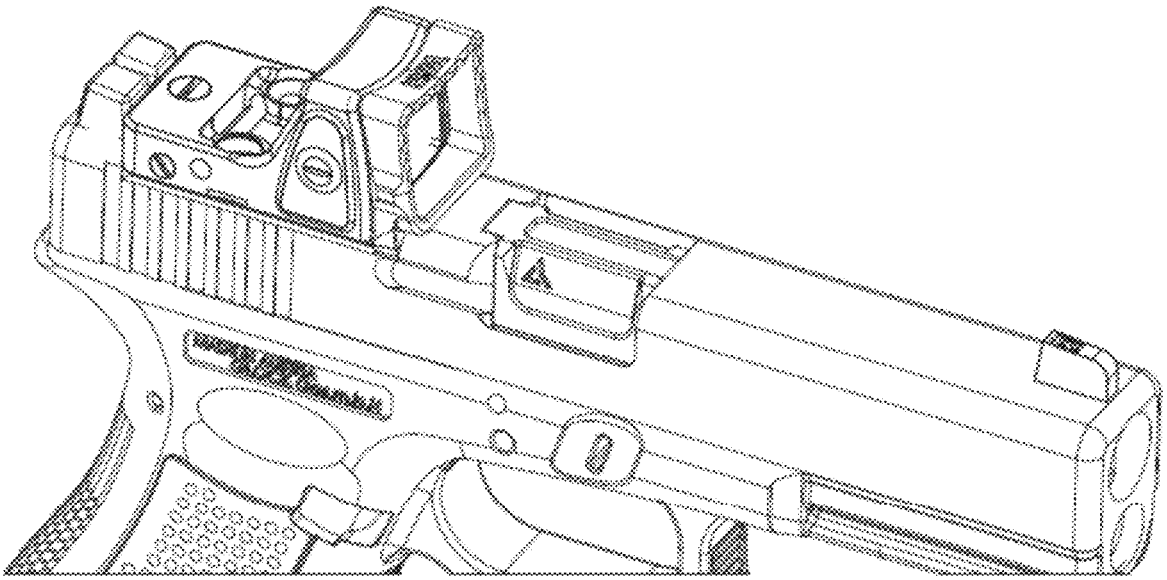
FIG. 14C illustrates a partial side view of a firearm including the optic guard of FIG. 14A with the RMR optic illustrated in FIG. 1F installed thereon.
Figure 14D:
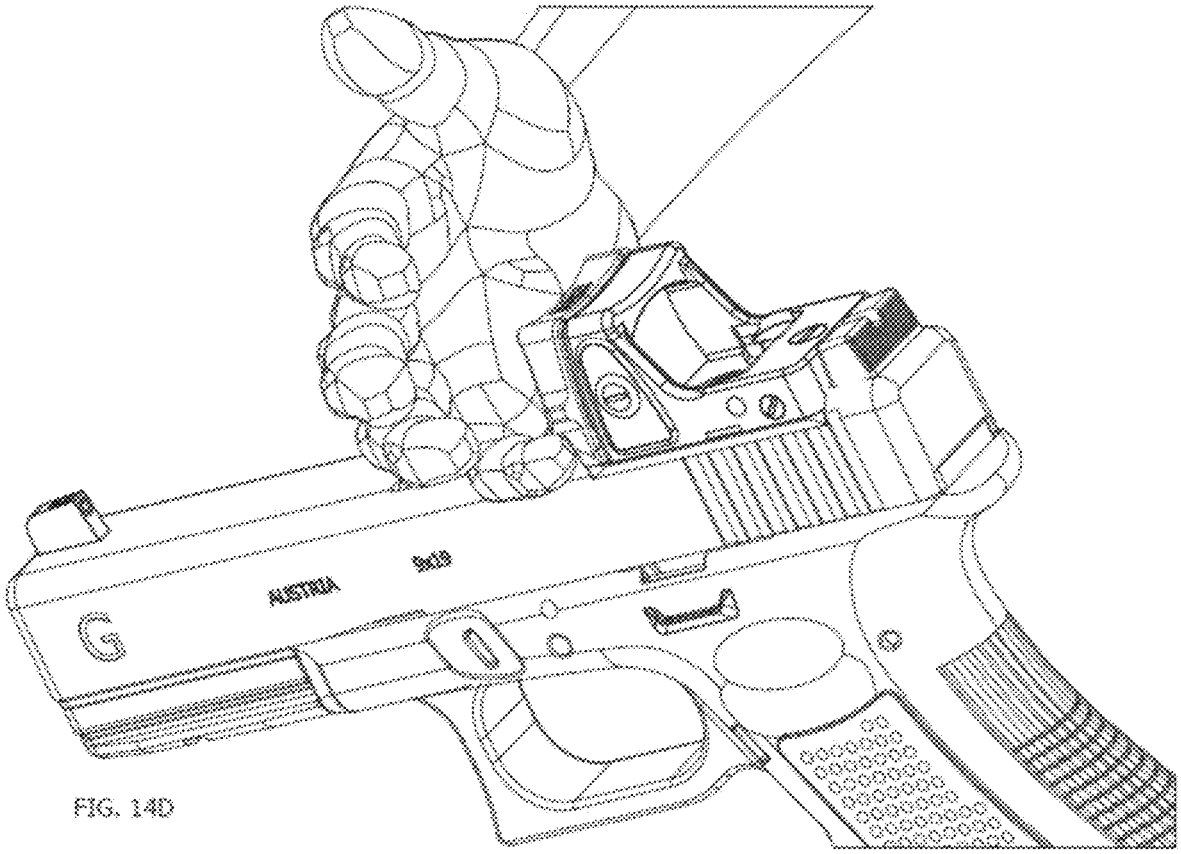
FIG. 14D illustrates charging a slide using a grip location provided on an optic guard.

FIG. 14C illustrates a partial side view of a firearm including the optic guard 1400 (FIG. 14A) with the RMR optic 154 (FIG. 1F) installed thereon. The gap between the back of the frame of the optic guard 1400 and the front of the housing of the RMR optic 154 may be the same as the gap described with respect to FIG. 12.

FIG. 14D illustrates charging a slide using a grip location provided on an optic guard. Charging may be accomplished without bumping the RMR optic 154 and without smudging the optic thereof. This charging grip point does not require the use of fingers/thumb (the scalloped grip on the side of the slide 100 of FIG. 1A is gripped using a finger and thumb). This charging grip point may be gripped using the palm instead, allowing the slide to be optimally charged (e.g., charged without smudging the optic and/or without bumping the RMR optic 154)—even in the case of an injury to the finger or thumb.

Referring again to FIG. 15, this optic guard 1500 with integrated bracket may be utilized with a different legacy slide than the legacy slide 100 of FIG. 1A. The underside of the bracket is arranged for attaching to a top exterior surface of the legacy slide. The top surface of the bracket (not shown) may be similar in any respect to the top surface of the mounting platform 1153 (FIG. 11A).

Having described and illustrated various examples herein, it should be apparent that other examples may be modified in arrangement and detail, e.g.:

Any slide assembly described herein may be arranged to include any optic mounting platform described herein and/or arranged to include any optic guard mount described herein, according to various embodiments. Any slide assembly described herein may be arranged to include any alignment system described herein, according to various embodiments. Any slide assembly described herein may be arranged to retrofit a firearm having a slide assembly or may be part of original equipment of a firearm, according to various embodiments.

The optic guards and the optic guard brackets described herein may be arranged to interoperate with any slide assembly described herein, or some other slide assembly currently known or later developed, according to various embodiments.

Compensator System with Mounted Gas Port Device

Known compensators may thread onto an end of a barrel. These compensators may be arranged to receive gas exiting a muzzle of a barrel, such as from the muzzle 2 of the barrel 105 of FIG. 1A. These compensators provide gas recoil by redirecting a portion of the received gas from the muzzle 2 in a particular direction.

Figure 17A:
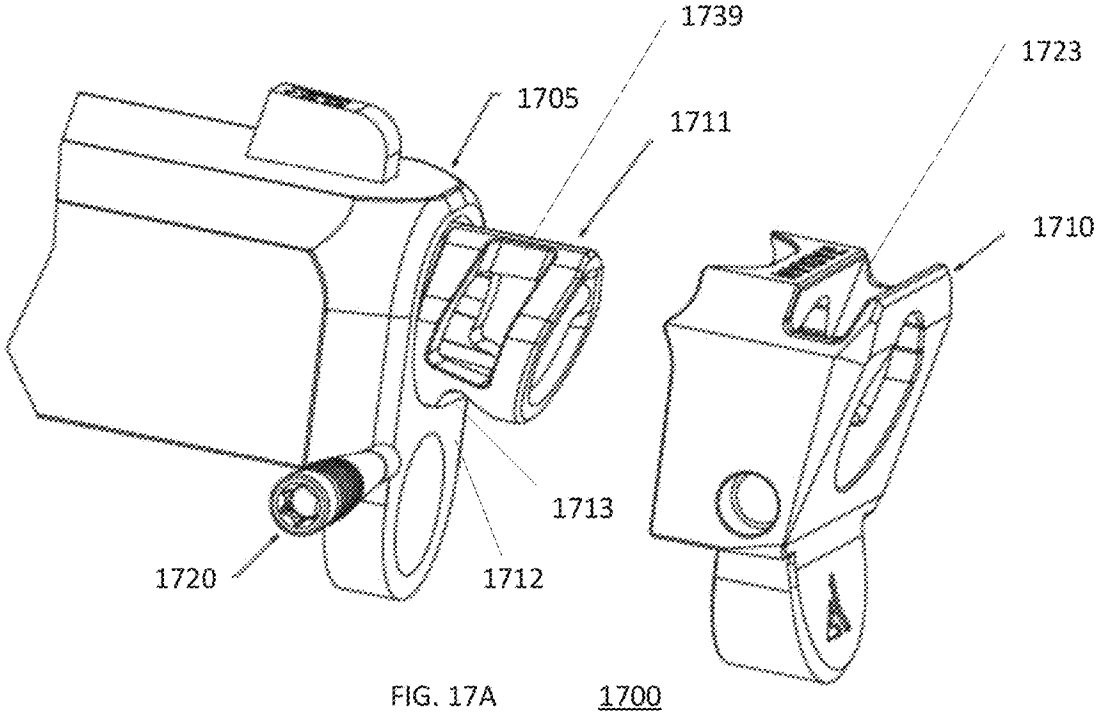
FIGS. 17A and 17B show an exploded view and an isometric view, respectively, of a compensator system.
Figure 17B:
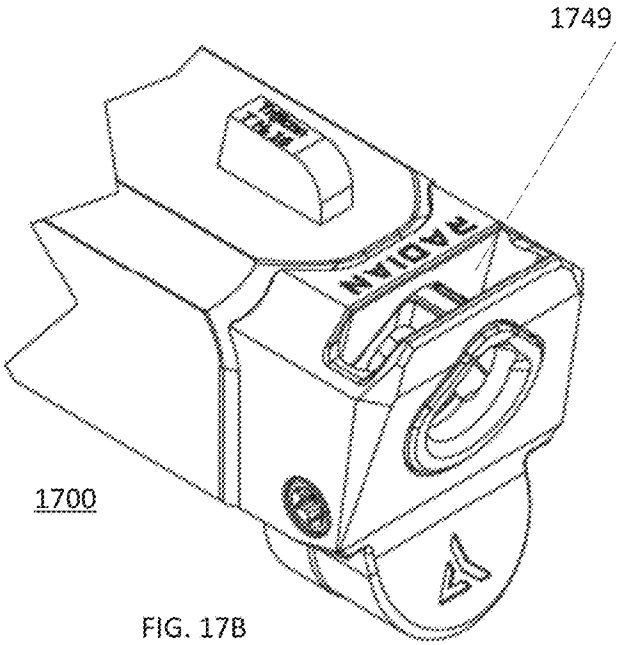

FIGS. 17A and 17B show an exploded view and an isometric view, respectively, of a compensator system 1700. In the compensator system 1700, the barrel 1711 may include an egress 1739 that may be similar to barrel egress 39 (FIG. 3) or any other barrel egress described herein. The compensator system 1700 may include a gas port device 1710 with an opening 1723 to expose the egress 1739 when the gas port device 1710 is mounted on a part of the barrel 1711 that protrudes from the slide 1705. The opening 1723 and the egress 1739 may form a gas port 1749 similar in any respect to the gas port 49 (FIG. 4A).

In contrast to compensators that receive all the gas from the muzzle of the barrel, the gas port device 1710 may receive the gas from the egress 1739 of the barrel 1711. The total length of the compensator system 1700 may be shorter than the total length of a barrel and a compensator in which the compensator threads onto the barrel and/or receives all the gas from a muzzle of a barrel.

The slide 1705 may be similar to the slide 100 in any respect. In various embodiments, the slide 1705 may have a front wall 1712 similar to the front wall illustrated in FIG. 1 (the front wall corresponding to the front interior wall 12 of slide 100). The egress 1739 may be located on a part of the barrel 1711 that protrudes from a bore 1713 in the front wall 1712, e.g., interior walls of the gas port 1749 may be different/separate than the front wall 1712 with the bore 1713.

The gas port device 1710 may be mounted to the barrel 1711 using any fasteners or other attachment device now known or later developed. In this example, the gas port device 1710 is mounted to the barrel 1711 using a taper pin 1720, which will be described in more detail later with respect to the description of FIG. 17F.

During the firing cycle, the barrel 1711 may lock up with the slide 1705 in a similar way that barrel 105 (FIG. 1) locks up with slide 100 (FIG. 1). Specifically, the bore 1713 defined by the front wall 1712 may have standard dimensions as a bore on "stock" slide. In the case of a glock-compatible firearm (which allows the muzzle end of the barrel to move upwards with respect to the slide during the firing cycle), the bore 1713 may be an eccentric bore. Due to this, unlike some other compensator assemblies that may not operate with standard-dimensioned slide, the compensator system 1700 is operable with slide 100 or any other slide with a front wall 1712 similar to the front wall of slide 100.

In some embodiments, compensator system 1700 may provide some recoil reduction even when gas port device 1710 is not mounted to the barrel 1711. Specifically, even when the firearm is fired without the gas port device 1710 attached, the egress 1739 may provide some base amount of recoil reduction (due to the gas venting from the egress 1739 to direct the gas in a direction that reduces recoil).

Figure 17F:
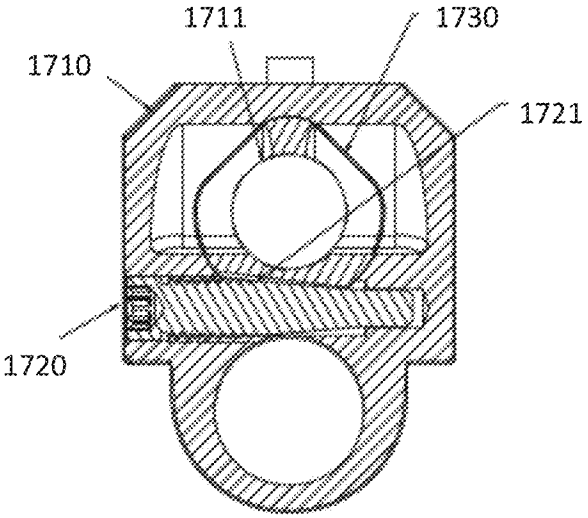
FIG. 17F illustrates a front view of a section of the compensator system taken along section line C of FIG. 17D.
Figure 17G:
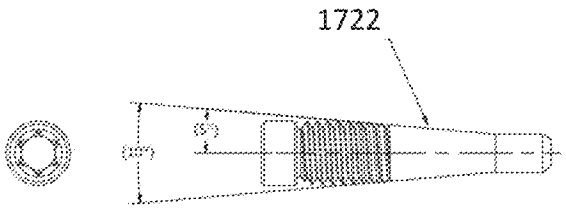
FIG. 17G illustrates the taper pin of FIG. 17F in more detail.
Figure 17E:
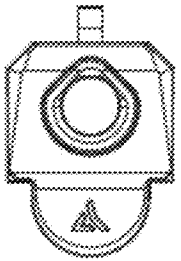
FIGS. 17C, 17D, and 17E illustrate a top view, a side view, and a front view, respectively, of the compensator system of FIGS. 17A-B.
Figure 17C:
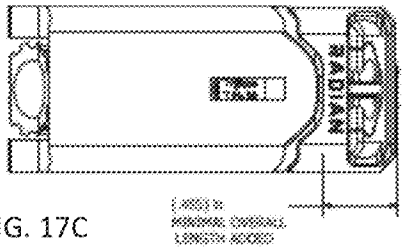
Figure 17D:
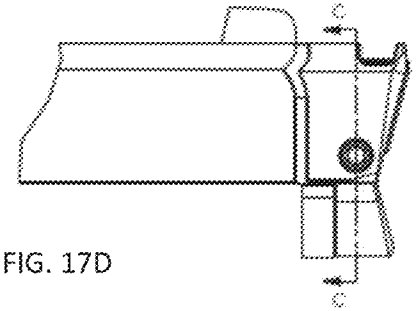

FIGS. 17C, 17D, and 17E illustrate a top view, a side view, and a front view, respectively, of the compensator system 1700. FIG. 17F illustrates a front view of a section of the compensator system 1700 taken along section line C. The taper pin 1720 may interface with a taper interface 1721 provided on a bottom of the barrel 1711 (FIG. 17A). FIG. 17G illustrates the taper pin 1720 in more detail. In this example, it includes a taper lock interface 1722 along part of its length (another part of the length includes threads as illustrated).

Figure 18A:
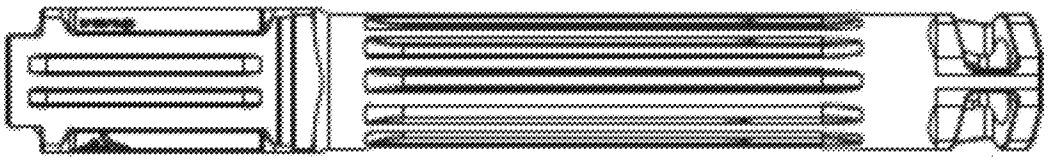
FIGS. 18A and 18B illustrate a top view and a side view of the barrel of FIG. 17A.
Figure 18B:
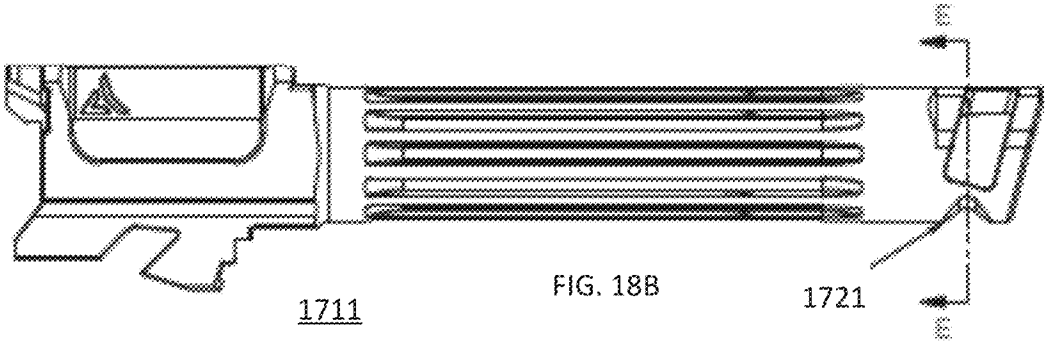
Figure 18C:
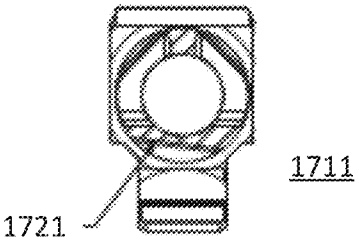
FIG. 18C illustrates a front view of a section of the barrel of FIGS. 18A-B, taken along section line E.

The taper interface 1721 is shown in more detail in FIGS. 18A-C. FIGS. 18A and 18B illustrate a top view and a side view, respectively, of the barrel 1711. FIG. 18C illustrates a front view of a section of the barrel 1711 (taken along section line E). In this example, the taper interface 1721 is a tapered "V" slot 1721. In other examples, a different slot may be provided, such as a rounded slot.

Figure 19:
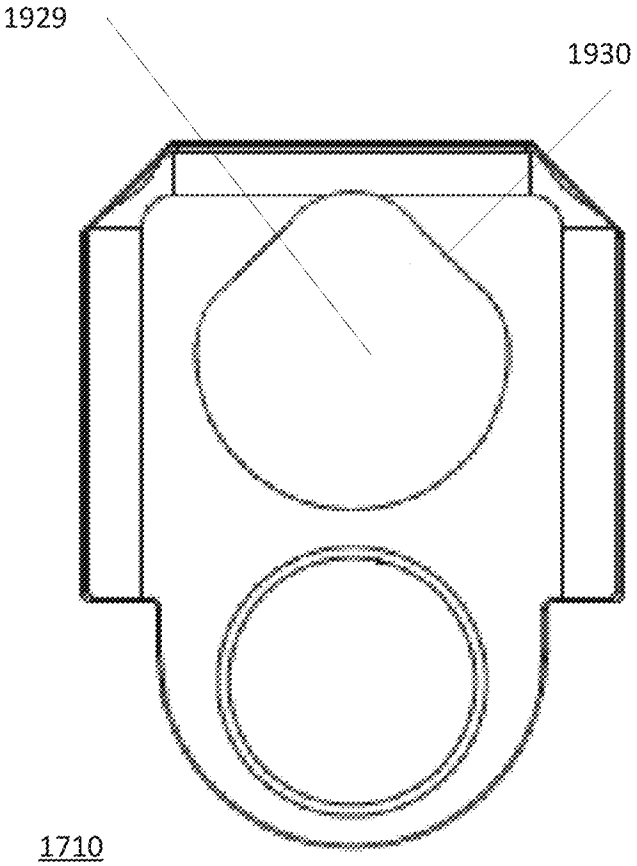
FIG. 19 illustrates a rear view of the gas port device of FIG. 17A.

Referring again to FIG. 17F, the part of the barrel 1711 on which the gas port device 1710 (FIG. 17A) is mounted may include indexing flats 1730 to mate with a corresponding indexing flats of the gas port device 1710. FIG. 19 illustrates a rear view of the gas port device 1710, which shows an opening 1929 in the gas port device 1710. The opening 1929 defines indexing flats 1930 to mate with the indexing flats 1730 (FIG. 17F). Referring again to FIG. 17F, when the taper pin 1720 is tightened (e.g., using a wrench tool in this example), the taper lock interface 1722 (FIG. 17G) contacts the corresponding taper interface 1721 of the bottom of the barrel 1711. In this example, the taper pin 1720 includes threading to interface with an internal thread in the gas port device 1710; however, this is not required. In other examples, a taper pin may not include threads—it could be driven into the hole in the gas port device 1710 to lockup with the taper lock interface 1721 provided in the bottom of the barrel 1711.

The location of the indexing flats of the barrel (and the indexing flats of the barrel) may be on any position around the barrel, such as either side the barrel, the top of the barrel, the bottom of the barrel, or any other orientation between those. In other examples, some other indexing face may be used that is different than the illustrated indexing flats (a curved profile, etc.) In this example, the timing system includes plural indexing faces, but in other examples it may possible and practical to use a single indexing face on the barrel 1711 and on the gas port device 1710.

Referring again to FIG. 17G, in this example the taper pin 1720 includes four sections: a threaded section, a tapered section, and a straight section proximate to each end. As the taper pin starts to engage the taper interface 1721 (FIG. 17F) the straight sections may prevent the taper pin 1720 from being urged away from the barrel 1711 (FIG. 17F). Specifically, the gas port device 1710 may be arranged with a hole of a corresponding diameter that the small diameter straight section fits into and a counter bore with a corresponding diameter that the large diameter straight section fits into (this can be seen in FIG. 17F). The taper pin 1720 may be held into place on both sides of the taper lock interface 1722 by these straight sections to keep either end of the taper pin 1720 from moving away from the barrel.

Figure 24B:
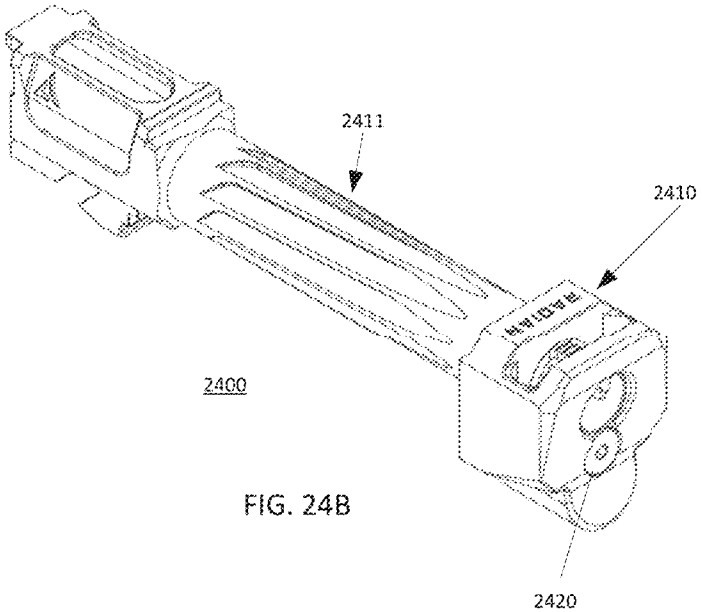
FIGS. 24A-D show an exploded view, an isometric view, a front view, and a cross-sectional side view of another compensator system with a threaded barrel.

In other embodiments, the taper pin may not require the straight sections proximate to each end. FIG. 24A-C illustrate an example without these straight sections proximate to each end of the taper pin 2420. A taper pin may include a single continuous taper with a first region having a taper lock interface to contact a taper interface of a barrel and a second region to contact the barrel-mountable accessory. In other embodiments, a taper pin may have two distinct sections—a tapered first section to contact a taper interface of a barrel and a second non-tapered (or differently tapered) section to contact the barrel-mountable accessory (this is illustrated in the embodiment of FIGS. 24A-D—in this example a tapered section is between the a threaded section and the driving end of the taper pin 2420).

Figure 20B:
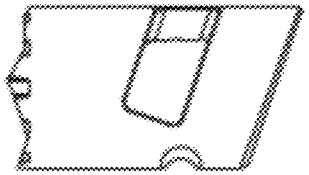
FIG. 20B is a detail K of FIG. 20A.
Figure 20A:
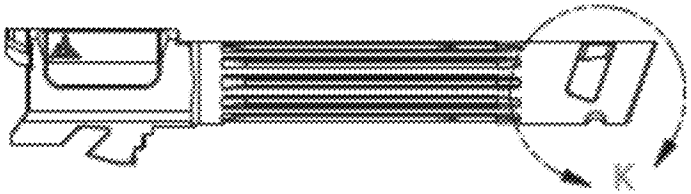
FIG. 20A illustrates a barrel that may be similar in any respect to the barrel of FIG. 17A.

FIG. 20A illustrates a barrel 2011 that may be similar in any respect to barrel 1711 (FIGS. 18A-B). FIG. 20B is a detail K showing an interface with a round taper profile (instead of a tapered "V" slot). An interface on a bottom of the barrel may have a V profile, a round profile, or any other profile, according to various embodiments. The location of the interface of the barrel (and the taper lock interface) may be on any position around the barrel, such as either side the barrel, the top of the barrel, the bottom of the barrel, or any other orientation between those.

Figure 21A:
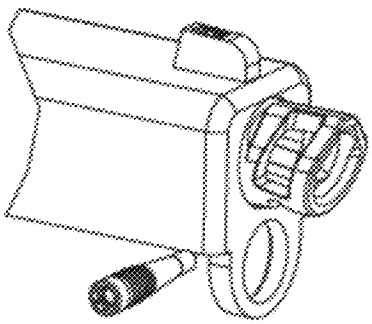
FIGS. 21A, 21B, 21C, and 21D show an exploded view, an isometric view, a top view, and a side view, respectively, of another compensator system.
Figure 21B:
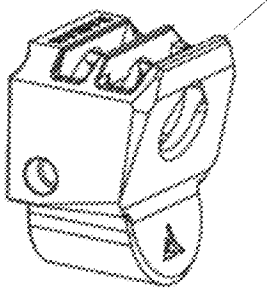
Figure 21B:
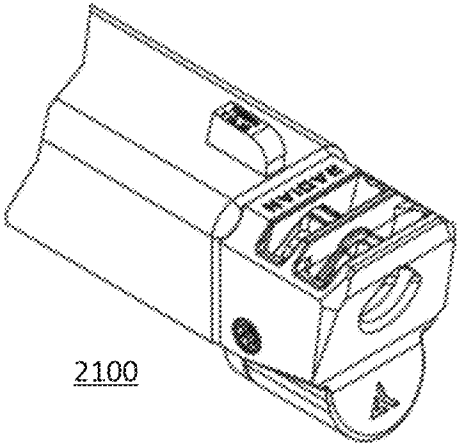
Figure 21C:
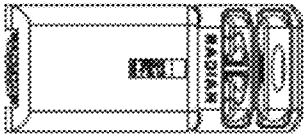
Figure 21D:
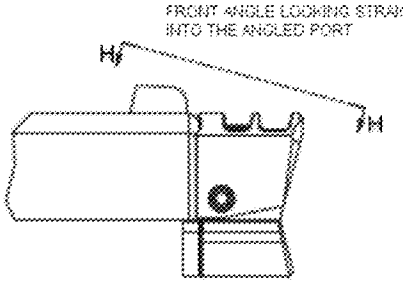
Figure 21E:
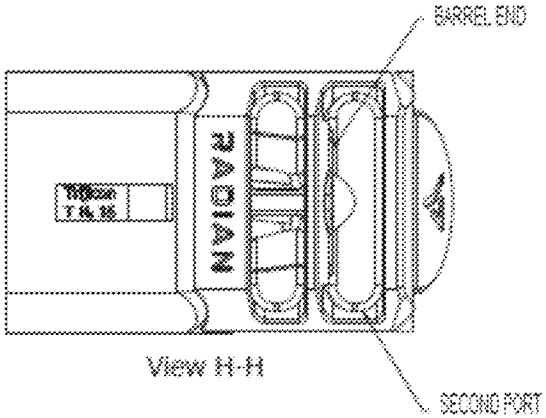
FIG. 21E shows a view taken from line H of FIG. 21D.

FIGS. 21A, 21B, 21C, and 21D show an exploded view, an isometric view, a top view, and a side view, respectively, of another compensator system 2100 utilizing a dual-ported gas port device 2110. All other components of the compensator system 2100 may be the same as the compensator system 1700 (FIG. 17A). FIG. 21E shows a view taken from the perspective of the arrows of line H of FIG. 21D.

Figure 21F:
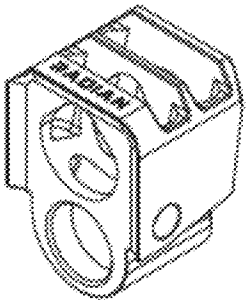
FIG. 21F shows an isometric view of the slide-facing side of the gas port device of FIG. 21A.

Gas port device 2110 may receive gas from a barrel egress similar to gas port device 1710 (FIG. 17A), but also may receive additional gas from the muzzle of the barrel. Accordingly, gas port device 2110 may provide additional recoil reduction. A user may interchangeably mount gas port devices 1710 and 2110 on a same barrel (or run with no gas port device attached for base recoil reduction), depending on a desired amount of recoil reduction. FIG. 21F shows an isometric view of the slide-facing side of gas port device 2110.

Figure 22B:
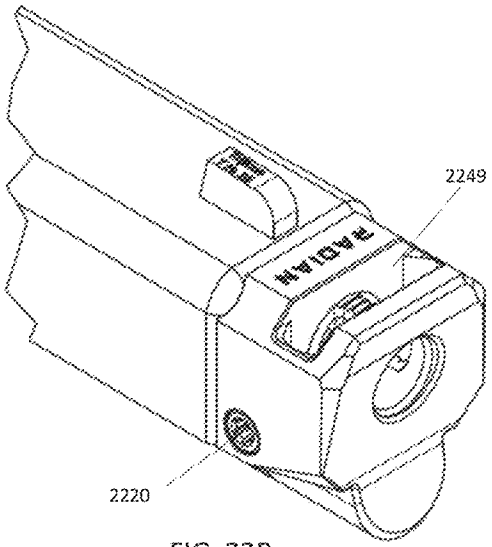
FIGS. 22A, 22B, 22C, 22D, and 22E show an exploded view, an isometric view, a top view, and a front view, and a cross-sectional side view, respectively, of another compensator system with a threaded barrel.
Figure 22E:
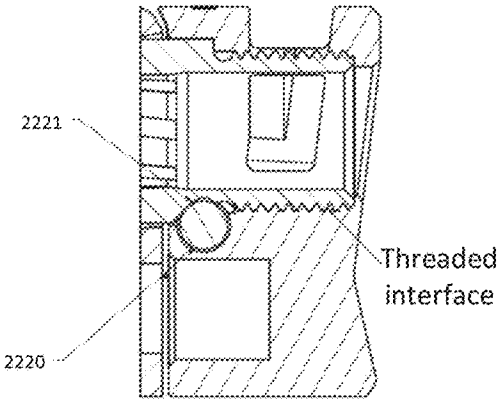

Although the various above-described embodiments of a compensator system with mounted gas port device feature a non-threaded barrel, it should be appreciated that any of the features included in those compensator systems may be utilized in a compensator system with a threaded barrel. FIGS. 22A-24E illustrate examples in which threaded barrels are used. FIGS. 22A, 22B, 22C, 22D, and 22E show an exploded view, an isometric view, a top view, and a front view, and a cross-sectional side view, respectively, of another compensator system 2200 with a threaded barrel 2211. FIG. 23 shows a side view of a threaded barrel-mounted accessory 2305 installed on the threaded barrel 2211 of the compensator system 2200 of FIGS. 22A-E. FIGS. 24A-D show an exploded view, an isometric view, a front view, and a cross-sectional side view of another compensator system 2400 with a threaded barrel 2411.

Figure 22A:
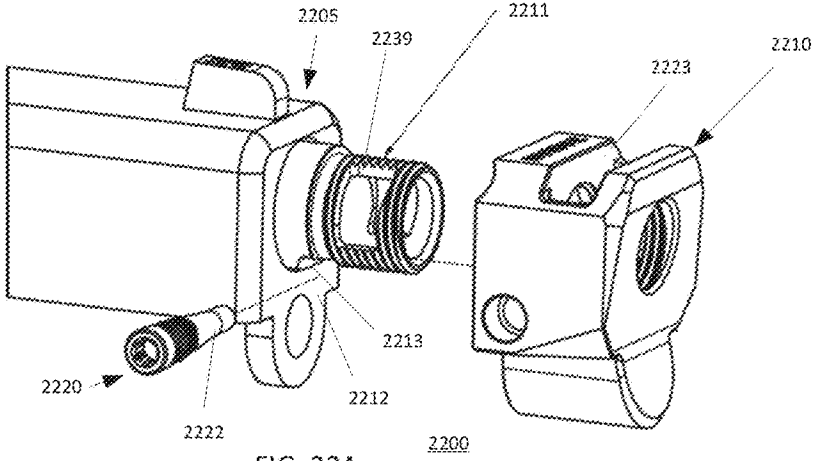
Figure 22D:
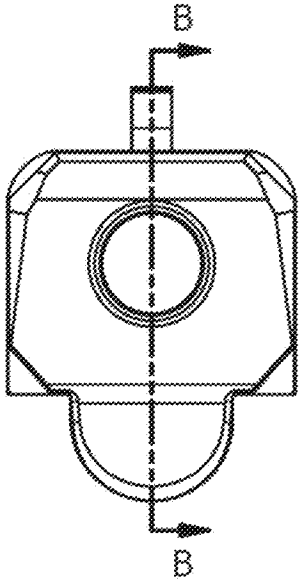
Figure 22C:
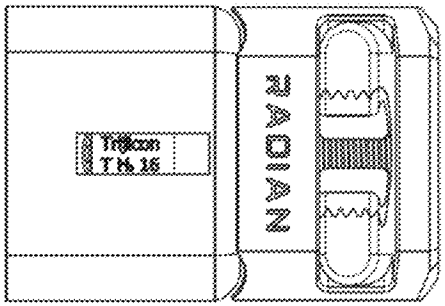
Figure 23:
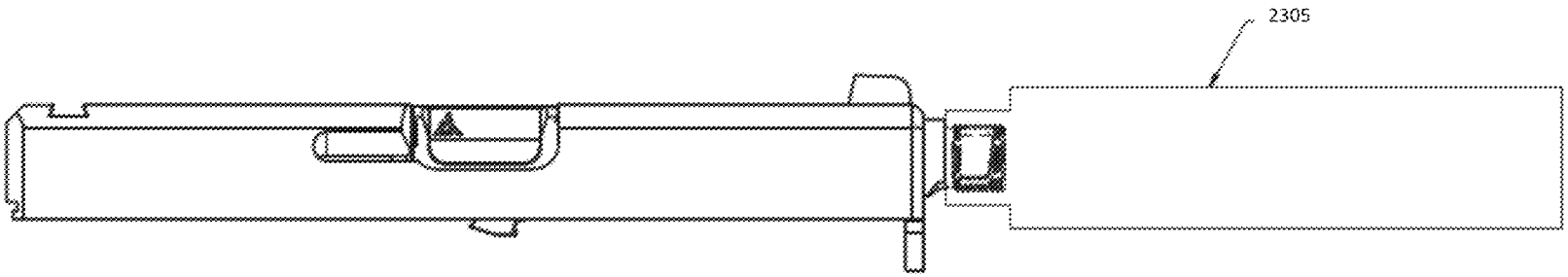
FIG. 23 shows a side view of a threaded barrel-mounted accessory installed on the threaded barrel of the compensator system of FIGS. 22A-E.

Referring to FIG. 22A, in the compensator system 2200, the barrel 2211 may include an egress 2239 that may be similar to barrel egress 39 (FIG. 3) or any other barrel egress described herein. The compensator system 2200 may include a gas port device 2210 with an opening 2223 to expose the egress 2239 when the gas port device 2210 is mounted on a part of the barrel 2211 that protrudes from the slide 2205. The opening 2223 and the egress 2239 may form a gas port 2249 similar in any respect to the gas port 49 (FIG. 4A).

In contrast to compensators that receive all the gas from the muzzle of the barrel, the gas port device 2210 may receive the gas from the egress 2239 of the barrel 2211. The total length of the compensator system 2200 may be shorter than the total length of a barrel and a compensator in which the compensator threads onto the barrel to receive all the gas from the muzzle of a barrel.

The slide 2205 may be similar to the slide 100 in any respect. In various embodiments, the slide 2205 may have a front wall 2212 similar to the front wall illustrated in FIG. 1 (the front wall corresponding to the front interior wall 12 of slide 100). The egress 2239 may be located on a part of the barrel 2211 that protrudes from a bore 2213 in the front wall 2212, e.g., interior walls of the gas port 2249 (FIG. 22B) may be different/separate than the front wall 2212 with the bore 2213.

In this embodiment, the part of the barrel 2211 that protrudes from the bore 2213 in the front wall 2212 is threaded. The gas port device 2210 (which has corresponding threading to mate with the threading on the part of the barrel 2211) may be mounted to the barrel 2211 using this threading and the taper pin 2220, which may be similar in any respect to the taper pin 1720 described with respect to FIG. 17F.

Referring now to FIG. 22E, when the taper pin 2220 is tightened (e.g., using a wrench tool in this example), the taper locker interface 2222 (FIG. 22A) contacts the corresponding taper interface 2221 of the bottom of the barrel 2211. In this example, the taper pin 2220 includes threading to interface with an internal thread of the gas port device 2210; however, this is not required. In other examples, a taper pin may not include threads—it could be driven into the hole in the gas port device 2210 to lockup with the taper lock interface 2221 in the bottom of the barrel 2211.

Referring now to FIG. 23, a different barrel-mounted accessory may be mounted to the barrel 2211 (in place of the gas port device 2210 and the taper pin 2220). In this example, a known suppressor 2305 is shown. The threading on the barrel 2211 (FIG. 22A) may be arranged to mate with threading on the known suppressor 2305. The taper lock interface 2221 (FIG. 22E) may not contact the threading on the known suppressor 2305. In this way, the barrel 2211 (FIG. 22A) with the taper lock interface 2221 can be used with any known barrel-mounted accessories that are not arranged with taper lock interface features.

Referring again to FIG. 22E, it should be appreciated that the location of the taper interface 2221 on the barrel 2211 (FIG. 22A) may be variously located at any position on the barrel 2211. In some examples, the taper interface 2221 may be located on the side of the barrel 2211, instead on the bottom of the barrel 2211, for instance.

Additionally, although the taper pin 2220 (FIG. 22A) is side-mounted (e.g., arranged perpendicular to the barrel 2211) in this embodiment, other mountings of a taper pin are possible and practical. FIGS. 24A-D illustrated embodiment of a compensator system 2400 that may be similar in any respect to compensator system 2200 (or any other compensator system described herein) with a differently-oriented taper pin 2420 (e.g., not side-mounted and not perpendicular to the barrel 2411—this taper pin 2420 is mounted parallel to the barrel 2411 from the front end of the barrel 2411). Besides the different taper interface 2421, the barrel 2411 may otherwise be similar to the barrel 2211 (FIG. 22A) in any respect.

The taper interface 2421 in this example is a notch sloping downwardly looking from the front of the barrel (in contrast to the taper interface 2221 that is side sloping looking from the front of the barrel). The use of the notch on the taper interface 2421 (or any other taper interface described herein) is not required. In other examples, the taper interface 2421 may have a groove shape (such as a V-groove in which the V-shape can be seen looking from the front of the barrel 2211).

The gas port device 2410 may have an opening on a front end to receive the taper pin 2420 (rather than an opening on a side), but otherwise may be similar to the gas port device 2210 (FIG. 22A). FIG. 24C shows a front view in which the head of the taper pin 2420 is shown below the muzzle end of the barrel 2411.

Figure 24D:
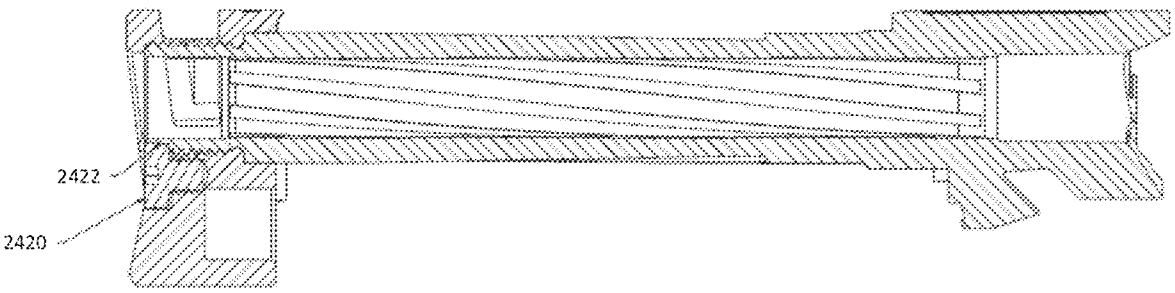
Figure 24A:
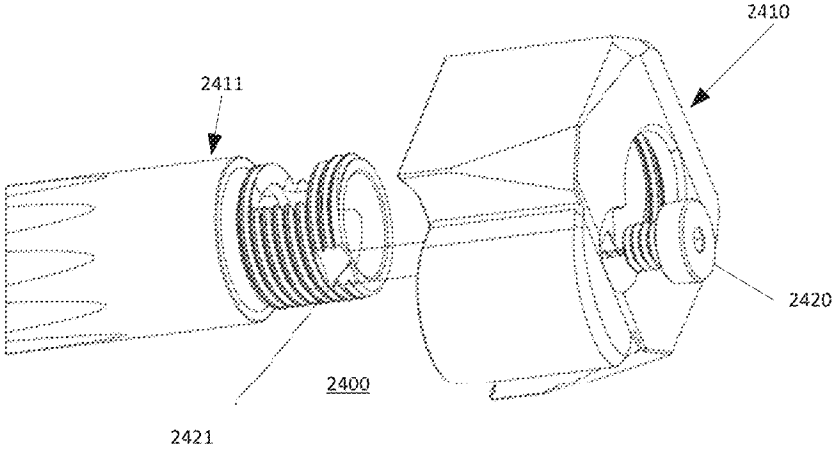
Figure 24C:
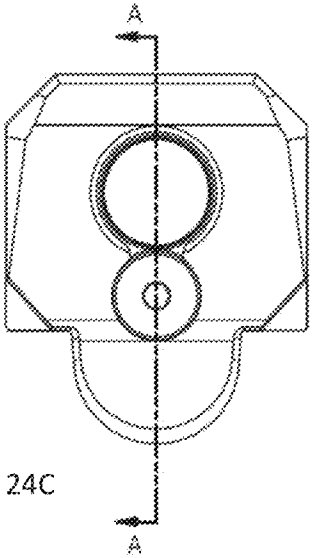

The taper locker interface 2422 of the taper pin 2420 is shown in FIG. 24D. The taper lock interface 2422 contacts the corresponding taper interface 2421 (FIG. 24A) of the bottom of the barrel 2211 (FIG. 24A). FIG. 24D shows that, in this embodiment, the taper lock interface 2422 is behind the threading of the taper pin 2420 (as compared to in front of the threading of the taper pin 2220 of FIG. 22A). The taper pin 2420 is also differently shaped than the taper pin 2220 of FIG. 22A, as illustrated in FIG. 24D.

In any compensator system described herein, the gas port device may include a sight tracker similar to the sight tracker 1699 (FIG. 16A-B). In any compensator system described herein, any barrel interior features described herein may be utilized in the barrel (including the barrel interior features described in reference to FIGS. 7A-9C).

Some embodiments include a retrofit assembly for a firearm, the retrofit assembly to provide the firearm with gas compensation to reduce recoil, the retrofit assembly comprising: a barrel having a muzzle end, a breech end, and a length having a first segment that includes the muzzle end of the barrel and a second segment that includes the breech end of the barrel, wherein an upper region of the first segment of the length of the barrel includes an egress for gas propelled from a chamber of a bore of the barrel; a slide around the second segment of the length of the barrel, wherein the slide has a front wall defining a bore, and wherein the first segment of the length of the barrel protrudes from the bore of the front wall of the slide; and a gas port device mounted to the first segment of the length of the barrel, wherein the gas port device defines an opening to expose the egress of the first segment of the length of the barrel. The firearm may be a Glock compatible firearm, or some other firearm. The bore in the front wall of the slide may be an eccentric bore (in the case of a Glock compatible firearm), or some other circular shape depending on the firearm.

Barrel-Mounted Accessory Taper Lock Interface

Various features of the taper lock interface described with respect to FIG. 17F can be applied to any compensator (or other barrel-mounted accessory), including compensators that receive gas only from a muzzle of a barrel. Known compensators may require a threaded barrel. One problem with a threaded barrel is that a compensator may become loose due to vibrations of repeated firing cycles. One embodiment of a compensator with a taper locker interface includes a compensator mountable to a part of a barrel that protrudes from the front wall of the slide. This barrel may not include the egress 1739 (FIG. 17A) and/or may not be ported. The compensator may be arranged to redirect gas exiting from a muzzle of a barrel.

In this embodiment, the compensator may include a taper lock interface similar to taper interface 1721 of FIG. 17F. The compensator may include a taper pin similar to any taper pin described herein.

In some embodiments, the compensator may also include an opening similar to opening 1929 (FIG. 19), which may define indexing flats (similar to indexing flats 1930) to mate with indexing flats on the protruding part of the barrel; however, this is not required. In other embodiments, the compensator may be arranged to mount onto, say, a round barrel (wherein the barrel does not include indexing flats).

In any embodiment of a compensator with any of the taper lock interface features described with respect to FIG. 17F (e.g., the taper pin and optionally the indexing flats), the taper lock interface may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after re-mounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using a taper lock interface as described herein can be mounted identically in a repeatable fashion, the bore of the compensator can be closer in size to the bore of the barrel. Therefore, the use of the taper lock interface allows further optimization of gas flow for improved recoil reduction compared to compensators that thread onto threaded barrels.

A compensator with a taper lock interface may have a lower region that is shorter than an upper region of the compensator—to mate with a barrel having a sloped muzzle end similar to the sloped muzzle end of the barrel 1711 of FIG. 17A. This is due to the small profile of the taper lock interface on the bottom of the barrel. This may minimize the impact of the compensator increasing the length of the firearm (this wedge profile may allow the firearm to be holstered more easily than firearms with compensators that have a lower region that is the same length as the upper region of the compensator).

In the embodiments described above, the barrel-mounted accessory is a compensator. However, the taper lock interface may be used for any barrel-mounted accessories, including accessories to adapt a barrel to a silencer/suppressor (such as a recoil booster—also known as a Nielsen device) or any other barrel-mounted accessory.

Although the various above-described embodiments of barrel-mounted accessories with taper lock interfaces feature non-threaded barrels, it should be appreciated that any of the features included in those embodiments may be utilized in a firearm assembly or firearm with a threaded barrel. FIGS. 22A-24D illustrate embodiments in which the barrel-mounted accessory is a gas port device, but any of the features described with respect to FIGS. 22A-24D may be used in a threaded barrel without the egress and/or with any barrel-mounted accessories.

In various embodiments described herein, the tapered section of the pin has a conical surface. However, in other embodiments the tapered section of the pin may have non-conical surfaces such as multiple faces (e.g., flat faces or curved faces with vertexes between the faces). The taper interface on the barrel may have one or more corresponding flat or curved faces.

Barrel-Mounted Accessory with Timing System

Various features of the timing system described with reference to FIGS. 17F and 19, e.g., the indexing flats 1730 and 1930, may be used in a compensator (or some other barrel-mounted accessory) with any attachment interface that is now known or later developed (e.g. not limited to the taper lock interface). For instance, the bottom of the compensator (e.g., an apex of the bottom of the compensator) may have a threaded hole to receive a threaded screw. When the screw is tightened, the indexing flats are pressed together. Other mechanisms for pressing the indexing flats together may be used in other examples.

The indexing flats may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after remounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using indexing flats as described herein can be mounted identically in a repeatable fashion, the bore of the compensator can be closer in size to the bore of the barrel. Therefore, the use of the indexing flats allows further optimization of gas flow for improved recoil reduction compared to compensators that thread onto threaded barrels.

In the embodiments described above, the barrel-mounted accessory is a compensator with the barrel egress. However, it should be appreciated that the timing system may be used for any barrel-mounted accessories, including compensators without the barrel egress, accessories to adapt a barrel to a silencer/suppressor (such as a recoil booster), or any other barrel-mounted accessory.

In the embodiments described above, the barrel-mounted accessory is a compensator with the barrel egress. However, it should be appreciated that the taper lock interface may be used for any barrel-mounted accessories, including compensators without the barrel egress, accessories to adapt a barrel to a silencer/suppressor (such as a recoil booster), or any other barrel-mounted accessory.

In one embodiment in which the taper lock interface is used with a compensator without a barrel egress, the muzzle end of the barrel may have the same features as barrel 2211 (FIG. 22A)—excluding the egress 2239. This barrel may be compatible with a known threaded compensator that may receive gas from the muzzle end of the barrel, as well as with barrel-mounted accessories having a taper lock interface.

In one embodiment, a barrel-mounted "adapter"—to allow a non-threaded barrel to operate with threaded accessories—is provided. The non-threaded barrel may have the same features as barrel 1711 (FIG. 17A)—excluding the egress 1739. The adapter may have a back and side similar to the back and side of gas port device 1710 (or some other taper lock interface features described herein). The front of the adapter may have a threaded barrel-shaped projection similar to the muzzle end of barrel 2211 (FIG. 22A)—excluding the taper lock interface 1721. Therefore, the adapter with the taper lock interface on its back side may adapt the non-threaded barrel to receive a known threaded barrel-mountable accessory (such as a known threaded suppressor) on the adapter's front side.

In the embodiments illustrated here, the taper lock interface is used for a barrel-mounted accessory on a pistol. However, the taper lock interface may be used for barrel-mounting an accessory (such as a suppressor) to any firearm, including rifles or other long guns.

EXAMPLES

Compensator Assembly

Examples A1+, F1+ and G1+ correspond to examples herein in which an egress on a barrel may align with an opening on a device around to barrel to expose the egress to provide gas compensation. These examples may be similar to embodiments described with respect to FIGS. 2A-B, 3, 4A-B, 5A-E, 6A-E, 7A-D, 8A-C, 9A-C, 10A-E, 16A-D, 17A-B, 17A-G, 18A-C, 19, 20A-B, 21A-F, 22A-E. 23, and 24A-D.

Optic Mounting Platform

Examples B1+ correspond to examples herein in which an egress on a barrel may align with an opening on a device around to barrel to expose the egress to provide gas compensation. These examples may be similar to embodiments described with respect to FIGS. 11A-E, 12, and 13.

Optic Guard

Examples C1+ and D1+ correspond to examples herein with an optic guard. These examples may be similar to embodiments described with respect to FIGS. 12, 13, 14A-D, and 15.

Alignment System

Examples E1+ correspond to examples with an alignment system. These examples may be similar to embodiments described with respect to FIGS. 10A-E.

Taper Lock for Barrel-Mounted Device

Examples H1+ correspond to examples with a taper lock for a barrel-mounted device. These examples may be similar to embodiments described with respect to FIGS. 17A-G, 18A-C, 20A-B, 21A-E, 22A-E, 23, and 24A-D.

Timing System to Mount Barrel Mounted Device to Barrel

Examples I1+ correspond to examples with a timing system to mount a barrel-mounted device to a barrel. These examples may be similar to embodiments described with respect to FIGS. 17A-G, 18A-C, and 19.

Example A1 is a retrofit assembly for a firearm, the retrofit assembly to provide the firearm with gas compensation to reduce recoil, the retrofit assembly comprising: a barrel having a muzzle end, a breech end, and a length, wherein the length includes a barrel hood segment proximate to the breech end and a bore length segment proximate to the muzzle end, and wherein an upper region of the bore length segment includes an egress for gas propelled from a chamber inside the barrel hood segment; a slide around the barrel, the slide including a barrel hood channel to receive the barrel hood segment through a range of motion of the slide relative to the barrel responsive to a firing of the firearm, wherein the barrel hood channel is defined by a length of interior surfaces of a top and sides of the slide; and the slide further including an opening in the slide, the opening to expose the egress of the bore length segment of the barrel; wherein the interior surfaces of the top and sides of the slide further define an arch in front of the barrel hood channel, wherein a front surface of the arch is behind or aligned with the egress of the barrel.

Example A2 includes the retrofit assembly of example A1 or any other example herein, wherein an underside of the arch is arranged to slidingly engage the upper region of the bore length segment in part of the range of motion.

Example A3 includes the retrofit assembly of examples A1-A2 or any other example herein, wherein a profile of an underside of the arch corresponds to a profile of the upper region of the bore length segment of the barrel.

Example A4 includes the retrofit assembly of examples A1-A3 or any other example herein, wherein a slope of the underside of the arch is non-linear.

Example A5 includes the retrofit assembly of examples A1-A4 or any other example herein, wherein a portion of a slope of the underside of the arch is linear.

Example A6 includes the retrofit assembly of examples A1-A5 or any other example herein, wherein the profiles comprise curves having a same degree of curvature.

Example A7 includes the retrofit assembly of examples A1-A6 or any other example herein, wherein the front surface of the arch forms a gas port with the egress to guide the gas in a direction that provides the gas compensation to reduce the recoil.

Example A8 includes the retrofit assembly of examples A1-A7 or any other example herein, wherein the opening forms the gas port with the front surface of the arch and the egress.

Example A9 includes the retrofit assembly of examples A1-A8 or any other example herein, further comprising a group of through openings in sidewalls of the gas port, wherein each through opening has a first end on a surface of one of the sidewalls of the gas port and a second end on an exterior of a corresponding side of the sides of the slide.

Example A10 includes the retrofit assembly of examples A1-A9 or any other example herein, wherein the egress comprises one or more openings in the barrel, and wherein the opening in the top of the slide comprises a single contiguous opening or a plurality of openings.

Example A11 includes the retrofit assembly of examples A1-A10 or any other example herein, wherein the top of the slide defines an additional opening for a sight, wherein the additional opening for the sight located behind the arch.

Example A12 includes the retrofit assembly of examples A1-A11 or any other example herein, wherein the top of the slide defines a window located behind the arch, the window to expose the upper region of the bore length segment of the barrel.

Example A13 includes the retrofit assembly of examples A1-A12 or any other example herein, wherein a portion of a bore of the bore length segment is smooth, the smooth portion of the bore located between the egress and the muzzle end of the bore.

Example A14 includes the retrofit assembly of examples A1-A13 or any other example herein, wherein an edge transition between the egress and the bore comprises a chamfer.

Example A15 includes the retrofit assembly of examples A1-A14 or any other example herein, further comprising a circumferential groove on the bore of the bore length segment, wherein the circumferential groove corresponds with an edge of the egress.

Example A16 includes the retrofit assembly of examples A1-A15 or any other example herein, wherein the circumferential groove comprises sloped sidewalls.

Example A17 includes the retrofit assembly of examples A1-A16 or any other example herein, wherein the circumferential groove comprises side surfaces and a bottom surface, wherein the side surfaces comprise sloped sidewalls.

Example A18 includes the retrofit assembly of examples A1-A17 or any other example herein, the barrel length segment is non-cylindrical and an upper surface of the barrel length segment comprises one of a protrusion or groove to mate with a groove or protrusion defined by an underside of the arch.

Example A19 includes the retrofit assembly of examples A1-A18 or any other example herein, wherein the upper section of the bore length segment further defines a sight tracker located proximate to the egress.

Example A20 includes the retrofit assembly of examples A1-A19 or any other example herein, wherein the sight tracker defines an additional egress.

Example A21 is a firearm, comprising: a barrel having a muzzle end, a breech end, and a length, wherein the length includes a barrel hood segment proximate to the breech end and a bore length segment proximate to the muzzle end, and wherein an upper region of the bore length segment includes an egress for gas propelled from a chamber inside the barrel hood segment; and a slide around the barrel, the slide including a barrel hood channel to receive the barrel hood segment through a range of motion of the slide relative to the barrel responsive to a firing of the firearm, wherein the barrel hood channel is defined by a length of interior surfaces of a top and sides of the slide; and the slide further including an opening in the slide, the opening to expose the egress of the bore length segment of the barrel; wherein the interior surfaces of the top and sides of the slide further define an arch in front of the barrel hood channel, wherein a front surface of the arch is behind or aligned with the egress of the barrel.

Example A22 is the firearm of example A21 or any other example herein, further comprising any of the features of the retrofit assembly of any of examples A1-A21.

Example B1 is an apparatus, comprising: a slide having a top and sides; an optic mounting platform integrally formed from at least the top of the slide; and a grip for charging the slide, the grip integrally formed from sloped exteriors of the sides of the slide, the sloped exteriors located beneath the optic mounting platform, wherein each sloped exterior is sloped inward from a first upper location on the sloped exterior to a second location below the first upper location on the sloped exterior.

Example B2 includes the apparatus of example B1 or any other example herein, wherein the apparatus comprises a firearm or a firearm retrofit assembly.

Example B3 includes the apparatus of any of examples B1-B2 or any other example herein, further comprising: an optic guard mount integrally formed from the top or sides of the slide.

Example B4 includes the apparatus of any of examples B1-B3 or any other example herein, further comprising an optic guard installable using the optic guard mount, wherein the optic guard includes: a mounting section to mate with the optic guard mount; and a frame on the mounting section, the frame arranged to protect an optic installed on the optic mounting platform and a top and sides of a housing of the optic.

Example B5 includes the apparatus of any of examples B1-B4 or any other example herein, wherein the frame includes frame segments including a top frame segment, a bottom frame segment, and side frame segments, wherein at least one of the frame segments includes grip indentions or grip bumps for charging the slide using the optic guard.

Example B6 includes the apparatus of any of examples B1-B5 or any other example herein, wherein the frame is a fully-enclosed frame.

Example B7 includes the apparatus of any of examples B1-B6 or any other example herein, wherein the optic mounting platform is arranged to form a sealed enclosure with a housing of a powered optic, wherein the optic mounting platform includes mounting holes surrounded by a smooth surface, the smooth surface to directly contact a seal of the powered optic.

Example B8 includes the apparatus of any of examples B1-B7 or any other example herein, wherein each sloped exterior comprises a continuous linear slope or a continuous non-linear slope.

Example B9 includes the apparatus of any of examples B1-B8 or any other example herein, wherein each sloped exterior comprises varying slopes.

Example B10 includes the apparatus of any of examples B1-B9 or any other example herein, wherein each sloped exterior has a section with a non-linear slope.

Example B11 includes the apparatus of any of examples B1-B10 or any other example herein, further comprising a barrel having a muzzle end, a breech end, and a length, wherein the length includes a barrel hood segment proximate to the breech end and a bore length segment proximate to the muzzle end; wherein an underside of the top of the slide defines a protrusion or groove to align with a groove or protrusion on the bore length segment to restrict movement of the muzzle end of the barrel within a plane perpendicular to a bore axis of the barrel and prevent rotational movement of the barrel relative to the slide.

Example B12 is an apparatus, comprising: a slide having a top and sides; an optic mounting platform integrally formed from at least the top of the slide; wherein the optic mounting platform includes a front end, a rear end, and sides: wherein the sides of the optic mounting platform overhang exterior surfaces of the sides of the slide; and wherein a top surface of the optic mounting platform comprises a recess in the top of the slide or the top surface of the optic mounting platform is lower than or coplanar with a section of the top of the slide, wherein the section is located in front of the front of the optic mounting platform or behind a back of the optic mounting platform.

Example B13 includes the apparatus of example B12 or any other example herein, further comprising a grip for charging the slide, the grip integrally formed from the exterior surfaces of the sides of the slide.

Example B14 includes the apparatus of any of examples B12-B13 or any other example herein, wherein surfaces of the sides of the optic mounting platform are orthogonal with the top surface of the optic mounting platform.

Example B15 includes the apparatus of any of examples B12-B14 or any other example herein, further comprising a barrel having a muzzle end, a breech end, and a length, wherein the length includes a barrel hood segment proximate to the breech end and a bore length segment proximate to the muzzle end; wherein an underside of the top of the slide defines a protrusion or groove to align with a groove or protrusion on the bore length segment to restrict movement of the muzzle end of the barrel within a plane perpendicular to a bore axis of the barrel and prevent rotational movement of the barrel relative to the slide.

Example B16 includes the apparatus of any of examples B2-B10 or the example of B12-B15 or any other example herein, wherein the slide is the slide of the retrofit assembly or firearm of any of examples A1-A22.

Example C1 is an apparatus, comprising: an optic guard to protect an optic of a firearm assembly and the housing of said optic, the optic guard including: a mounting section to couple to a firearm assembly independently of the housing of said optic; and a frame on the mounting section, the frame arranged to protect the optic and top and sides of the housing of said optic; wherein the optic guard is arranged to couple to the firearm assembly without contacting the optic and without contacting the housing of said optic.

Example C2 is the apparatus of example C1 or any other example herein, wherein the optic of the firearm assembly is arranged to piggyback-mount on an optic mountable on a firearm of the firearm assembly, and wherein the mounting section is arranged to separately piggyback mount to the optic mountable on the firearm.

Example C3 is the apparatus of any of examples C1-C2 or any other example herein, wherein the firearm assembly includes a slide assembly having any of the features of examples A1-B16.

Example D1 is an optic guard for a firearm assembly, the optic guard comprising: a bracket having a first side to attach to an optic adapter mounting interface of the firearm assembly, a second side that is opposite the first side, the second side defining an optic attachment, wherein the optic guard is arranged to protect an optic installed using the optic attachment and a top and sides of a housing of the optic; the bracket having a front section and a back section; and a frame integrally formed with the front section of the bracket or fixably attached to the front section of the bracket.

Example D2 is the optic guard of example D1 or any other example herein, wherein the bracket comprises a plate, wherein the first side comprises a first side of the plate and the second side comprises a second side of the plate, wherein the front section includes a front edge of the plate and the back section includes a back edge of the plate, wherein the plate has sloped side edges, the sloped side edges inwardly sloping from an edge of the second side of the plate to an edge of the first side of the plate.

Example D3 is the optic guard of any of examples D1-D2 or any other example herein, wherein the frame includes frame segments including a top frame segment, a bottom frame segment, and side frame segments, wherein at least one frame segment of the frame segments includes grip indentions or grip bumps for charging a slide of the firearm using the optic guard.

Example D4 is the optic guard of any of examples D1-D3 or any other example herein, wherein the frame comprises a fully-enclosed frame.

Example D5 is the optic guard of any of examples D1-D4 or any other example herein, wherein a lower region of the frame is non-releasably coupled to the front section of the bracket.

Example D6 is the optic guard of any of examples D1-D5 or any other example herein, wherein the front section of the bracket defines a groove or protrusion welded to a protrusion or groove defined by the frame.

Example D7 is the optic guard of any of examples D1-D6 or any other example herein, wherein the second side of the bracket is arranged to form a sealed enclosure with a bottom of the housing of the optic, wherein the second side of the bracket includes mounting holes surrounded by a smooth surface, the smooth surface to directly contact a seal of the powered optic.

Example D8 is the optic guard of any of examples D1-D7 or any other example herein, wherein the firearm assembly includes a slide assembly having any of the features of examples A1-B16.

Example E1 is a firearm or a firearm retrofit assembly, comprising: a barrel having a muzzle end, a breech end, and a length, wherein the length includes a barrel hood segment proximate to the breech end and a bore length segment proximate to the muzzle end; a slide around the barrel; and an alignment system to restrict movement of the muzzle end of the barrel within a plane perpendicular to a bore axis of the barrel and prevent rotational movement of the barrel relative to the slide, wherein the alignment system includes a groove or protrusion located on the bore length segment of the barrel, the groove or protrusion to mate with a protrusion or groove defined by an interior of the slide.

Example E2 is the firearm or firearm retrofit assembly of example E1 or any example herein, wherein the slide is the slide of any of the slide assemblies of any of examples A1-B16.

Example E3 is the firearm or firearm retrofit assembly of any of examples E1-E2, further comprising the optic guard of any of examples C1-D7.

Example F1 is a firearm or a firearm retrofit assembly to provide the firearm with gas compensation to reduce recoil, the firearm or retrofit assembly comprising: a barrel having a muzzle end, a breech end, and a length, wherein the length includes a barrel hood segment proximate to the breech end and a bore length segment proximate to the muzzle end, and wherein an upper region of the bore length segment includes an egress for gas propelled from a chamber inside the barrel hood segment; and a compensator assembly around the barrel, the compensator assembly including: a slide including a barrel hood channel to receive the barrel hood segment through a range of motion of the slide relative to the barrel responsive to a firing of the firearm, the slide further including a front wall with a bore to receive the bore length segment of the barrel; and an opening proximate to the front wall of the slide, the opening to expose the egress of the bore length segment of the barrel.

Example F2 includes the firearm or retrofit assembly of example F1 of any other example herein, wherein the egress of the barrel is located behind the front wall of the slide when the barrel is locked into the slide, and wherein the retrofit assembly further includes any of the features of examples A1+.

Example F3 includes the firearm or retrofit assembly of any of examples F1-F2 or any other example herein, wherein the egress of the barrel is located in front of the front wall of the slide when the barrel is locked into the slide and wherein the opening is defined by a gas port device mounted to the barrel.

Example G1 is a firearm or a firearm retrofit assembly to provide the firearm with gas compensation to reduce recoil, the firearm or firearm retrofit assembly comprising: a barrel having a muzzle end, a breech end, and a length having a first segment that includes the muzzle end of the barrel and a second segment that includes the breech end of the barrel, wherein an upper region of the first segment of the length of the barrel includes an egress for gas propelled from a chamber of a bore of the barrel; a slide around the second segment of the length of the barrel, wherein the slide has a front wall defining a bore, and wherein the first segment of the length of the barrel protrudes from the bore of the front wall of the slide; and a gas port device mounted to the first segment of the length of the barrel, wherein the gas port device defines an opening to expose the egress of the first segment of the length of the barrel.

Example G2 is the firearm or firearm retrofit assembly of example G1 or any example herein, wherein the gas port device is mounted to the first segment of the length of the barrel using a self-locking taper between the barrel and a tapered pin.

Example G3 is the firearm or firearm retrofit assembly of any of examples G1-G2 or any other example herein, further comprising one or more indexing faces on an exterior of the first segment of the length of the barrel to mate with one or more corresponding indexing faces of the gas port device to time the gas port device with the barrel.

Example G4 is the firearm or firearm retrofit assembly of any of examples G1-G3 or any other example herein, wherein the gas port device includes a sight tracker.

Example G5 is the firearm or firearm retrofit assembly of any of examples G1-G4 or any other example herein, wherein the opening is arranged to vent a first portion of the gas, wherein the first portion of the gas exits the egress of the barrel, wherein the gas port device includes an additional opening arranged to vent a second portion of the gas, wherein the second portion of the gas exits the muzzle of the barrel.

Example H1 is an accessory to mount onto a firearm's barrel, wherein the accessory is arranged to mount to the barrel using a self-locking taper between the barrel and a tapered pin.

Example H2 is the accessory of example H1 or any other example herein, wherein the accessory includes an opening to receive the barrel, wherein the opening defines one or more indexing faces to mate with one or more corresponding indexing faces of the barrel to time the accessory with the barrel.

Example H3 is the accessory of any of examples H1-H2 or any other example herein, wherein the accessory has any of the features of the gas port device of examples G1+.

Example H4 is the accessory of any of examples H1-H3 or any other example herein, wherein the barrel has any of the features of the barrel of examples G1+.

Example I1 is an accessory to mount onto a firearm's barrel, wherein the accessory includes: a timing system to time an orientation of the accessory relative to the barrel when the accessory is mounted onto the barrel, wherein the timing system includes: an opening to receive the barrel, wherein the opening defines one or more indexing faces to mate with one or more corresponding indexing faces of the barrel to time the accessory with the barrel; and means for pressing the one or more indexing faces defined by the opening against the one or more corresponding indexing faces of the barrel.

Example I2 is the accessory of example I1 or any other example herein, wherein the pressing means comprises a taper lock interface.

Example I3 is the accessory of any of examples I1-I2 or any other example herein, wherein the accessory has any of the features of the gas port device of examples G1+.

Example I4 is the accessory of any of examples I1-I3 or any other example herein, wherein the barrel has any of the features of the barrel of examples G1+.

We claim all modifications and variations coming within the spirit and scope of the following claims.

The invention claimed is:

1. A firearm-mountable article including a charging point to aid an operator in charging a firearm assembly, the firearm-mountable article comprising:

at least one body;

a light-transmissive element located rearwardly of at least part of the least one body, wherein a front-most light-transmissive surface of the light-transmissive element includes an exposed area having a height and a width; and the at least one body arranged to aid the operator in charging the firearm assembly, wherein at least a portion of a front surface of the at least one body includes a textured surface, the at least the portion of the front surface having a height and a width, and wherein the operator can apply a force to the textured surface to charge the firearm assembly;

the at least one body including a lower section arranged to attach to the firearm assembly at a predefined fore/aft position on the firearm assembly;

wherein said width of the at least the portion of the front surface is not less than the width of the exposed area of the front-most light-transmissive surface of the light-transmissive element.

2. The firearm-mountable article of claim 1, wherein the textured surface is arranged to 1) frictionally engage the operator's palm and 2) the front surface is arranged to prevent the operator's palm from smudging the front-most light-transmissive surface of the light transmissive element during said frictional engagement.

3. The firearm-mountable article of claim 1, wherein the textured surface comprises indentations or bumps.

4. The firearm-mountable article of claim 1, where the textured surface includes:

a horizontal section including end regions and an intermediary region between the end regions; and a vertical section extending downwardly from each of the end regions.

5. The firearm-mountable article of claim 1, wherein the lower section of the at least one body is arranged to mount in front of an optic mounting platform defined by the firearm assembly.

6. The firearm-mountable article of claim 1, wherein the height of the at least the portion of the front surface is not less than the height of the exposed area of the front-most light-transmissive surface of the light-transmissive element.

7. A firearm-mountable article, comprising:

a front end;

a light-transmissive element located rearwardly of at least part of the front end, a front-most light-transmissive surface of the light-transmissive element having an exposed area with a height and a width;

a bottom surface configured to attach to a firearm assembly, at a predefined fore/aft position on the firearm assembly; and the front end configure to aid an operator in charging a firearm assembly, wherein the front end includes at least top, left, and right members of a frame, said top, left, and right members defining at least a portion of a front surface of the front end, the at least the portion of the front surface having a height and a width;

wherein the at least the portion of the front surface includes a textured surface, and wherein the operator can apply a force to the textured surface to charge the firearm assembly; and wherein said width of said at least the portion of the front surface is not less than the width of the exposed area of the front-most light-transmissive surface of the light-transmissive element.

8. The firearm-mountable article of claim 7, wherein the textured surface includes:

a horizontal section including end regions and an intermediary region extending between the end regions; and a vertical section extending downwardly from each of the end regions.

9. The firearm-mountable article of claim 7, wherein the height of the at least the portion of the front surface is not less than the height of the exposed area of the front-most light-transmissive surface of the light-transmissive element.

10. An apparatus, comprising:

a frame section defining an opening, the frame section configured to aid an operator in charging a firearm assembly, wherein the frame section includes a front surface, at least a portion of the front surface including a textured surface, the at least the portion of the front surface having a height and a width, and wherein the operator can apply a force to the textured surface to charge the firearm assembly;

wherein the frame section is part of an upper section of the apparatus, and the apparatus further comprises a lower section configured to 1) attach to a unidirectional attachment interface of the firearm assembly, or 2) attach to the firearm assembly in front of the unidirectional attachment interface;

the lower section integrally formed with the frame section or fixably attached to the frame section;

wherein the frame section is arranged to expose an area of a front-most light-transmissive surface of a light-transmissive element, the exposed area having a height and a width, the frame section allowing a line of sight through the light-transmissive element and said opening when the lower section is attached to the firearm assembly; and wherein t he width of the at least the portion of the front surface is not less than the width of the exposed area of the front-most light-transmissive surface of the light-transmissive element.

11. The apparatus of claim 10, wherein the lower section includes a bottom surface to attach to the unidirectional attachment interface and wherein the lower section includes an additional surface defining a unidirectional attachment interface.

12. The apparatus of claim 10, wherein the unidirectional attachment interface comprises an optic mounting platform defined by the firearm assembly, and wherein the lower section is arranged to attach in front of the optic mounting platform.

13. The apparatus of claim 10, wherein the lower section comprises a plate, a bottom of which is configured to attach to the firearm assembly, wherein a front of the lower section includes a front edge of the plate and a back of the lower section includes a back edge of the plate; and wherein the frame section is integrally formed with the front of the lower section or fixably attached to the front of the lower section.

14. The apparatus of claim 13, wherein the plate includes an additional surface defining a unidirectional attachment interface, a part of which is arranged to form a sealed enclosure with a bottom of an optic sight, wherein the light-transmissive element is part of the optic sight;

wherein the unidirectional attachment interface defined by the additional surface of the plate includes mounting holes surrounded by a smooth surface of the additional surface of the plate, the smooth surface to directly contact a seal of the optic sight.

15. The apparatus of claim 10, wherein the frame section includes top, left, right, and bottom members, wherein the textured surface extends over more than one of the top, left, right, and bottom members.

16. The apparatus of claim 10, wherein a lower region of the frame section is non-releasably coupled to the lower section or the lower section defines an opening or protrusion welded to a protrusion or opening defined by the frame section.

17. The apparatus of claim 10, wherein the lower section is arranged to transfer at least a portion of energy from an impact to the frame section into a part of the firearm assembly that defines the unidirectional attachment interface without said at least the portion of energy transferring through a body supporting the light-transmissive element.

18. The apparatus of claim 17, further comprising a gap between the front-most light-transmissive surface of the light-transmissive element and a corresponding part of a back of the frame section.

19. The apparatus of claim 10, further comprising a gap between the front-most light-transmissive surface and a corresponding part of a back of the frame section.

20. The apparatus of claim 10, wherein the unidirectional attachment interface comprises an optic mounting platform defined by the firearm assembly, and wherein the lower section comprises a protrusion or channel arranged to mate with a channel or protrusion of the firearm assembly in front of the optic mounting platform.

21. The apparatus of claim 10, wherein a top of a slide of the firearm assembly defines a channel or protrusion in front of the unidirectional attachment interface, wherein the lower section comprises a protrusion or channel arranged to mate with the channel or protrusion defined by the top of the slide.

22. The apparatus of claim 10, wherein the line of sight passes under at least a portion of the frame section.

23. The apparatus of claim 10, wherein the textured surface comprises:

a horizontal section including end regions and an intermediary region between the end regions; and a vertical section extending downwardly from each of the end regions.

24. The apparatus of claim 10, wherein the frame section includes top, left, and right members.

25. The apparatus of claim 24, wherein the frame section further includes a bottom member having a length corresponding to a length of the top member.

26. The apparatus of claim 25, wherein the frame section comprises a fully-enclosed frame defined at least in part by the top, bottom, left, and right members, and the opening comprises a window, which is enclosed on all sides, by the frame section.

27. The apparatus of claim 24, wherein the opening is not enclosed by the frame section.

28. The apparatus of claim 10, wherein the height of the at least the portion of the front surface is not less than the height of the exposed area of the front-most light-transmissive surface of the light-transmissive element.

29. An apparatus, comprising:

a frame section including at least top, left, and right members, the at least top, left, and right members defining an opening, the frame section configured to aid an operator in charging a firearm assembly, wherein the frame section includes a front surface, at least a portion of the front surface including a grip texture, the at least the portion of the front surface having a height and a width, and wherein the operator can apply a force to the grip texture to charge the firearm assembly;

wherein the frame section is part of an upper section of the apparatus, and the apparatus further comprises a lower section configured to attach to the firearm assembly, the lower section integrally formed with the frame section or fixably attached to the frame section;

wherein the frame section is arranged to expose an area of a front-most light-transmissive surface of a light-transmissive element, allowing a line of sight through the light transmissive element and said opening when the lower section is coupled to the firearm assembly; and wherein the width of said at least the portion of the front surface is not less than a width of the exposed area of the front-most light-transmissive surface of the light-transmissive element.

30. The apparatus of claim 29, wherein when the lower section is coupled to the firearm assembly, the lower section directs at least a portion of energy from an impact to the frame section into a part of the firearm assembly without said at least the portion of energy traveling through a body supporting the light-transmissive element.

31. The apparatus of claim 30, wherein the lower section is further arranged to attach to the firearm assembly at a predefined fore/aft position on the firearm assembly.

32. The apparatus of claim 29, wherein the line of sight passes under at least a portion of the frame section.

33. The apparatus of claim 29, wherein the lower section comprises a plate;

wherein the plate includes a bottom surface and an additional surface that is opposite to the bottom surface of the plate, wherein the additional surface defines an optic attachment to locate a body mounted thereto in a predefined fore/aft position on the plate, wherein the body supports the light-transmissive element.

34. The apparatus of claim 29, wherein the grip texture comprises:

a horizontal section including end regions and an intermediary region between the end regions; and a vertical section extending downwardly from each of the end regions.

35. The apparatus of claim 29, wherein the height of the at least the portion of the front surface is not less than a height of the exposed area of the front-most light-transmissive surface of the light-transmissive element.

36. The apparatus of claim 29, wherein the opening comprises a window.

* * * * *